US012590436B2

(12) United States Patent
Sakuta et al.

(10) Patent No.: US 12,590,436 B2
(45) Date of Patent: Mar. 31, 2026

(54) SHOVEL CAPABLE OF PREVENTING MOTION THEREOF FROM BEING UNIFORMLY RESTRICTED

(71) Applicant: SUMITOMO CONSTRUCTION MACHINERY CO., LTD., Tokyo (JP)

(72) Inventors: Sou Sakuta, Chiba (JP); Takeya Izumikawa, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 1078 days.

(21) Appl. No.: 17/003,032

(22) Filed: Aug. 26, 2020

(65) Prior Publication Data

US 2020/0385953 A1 Dec. 10, 2020

Related U.S. Application Data

(63) Continuation of application No. PCT/JP2019/007936, filed on Feb. 28, 2019.

(30) Foreign Application Priority Data

Feb. 28, 2018 (JP) ..... 2018-034299

(51) Int. Cl.
*E02F 3/43* (2006.01)
*E02F 9/22* (2006.01)
*E02F 9/26* (2006.01)

(52) U.S. Cl.
CPC ..... *E02F 3/431* (2013.01); *E02F 3/435* (2013.01); *E02F 9/2221* (2013.01); *E02F 9/262* (2013.01); *E02F 9/265* (2013.01); *E02F 3/43* (2013.01)

(58) Field of Classification Search
CPC ..... E02F 9/24; E02F 9/245; E02F 9/26; E02F 9/264; E02F 9/265
(Continued)

(56) References Cited

U.S. PATENT DOCUMENTS 5,198,800 A * 3/1993 Tozawa ..... E02F 9/2033 340/685
5,704,429 A * 1/1998 Lee ..... E02F 9/2004 701/50

(Continued)

FOREIGN PATENT DOCUMENTS

JP H05-007749 U 2/1993
JP 2700710 1/1998

(Continued)

OTHER PUBLICATIONS

International Search Report for PCT/JP2019/007936 mailed on May 14, 2019.

*Primary Examiner* — Christopher J Sebesta
*Assistant Examiner* — Audrey L Lusk
(74) *Attorney, Agent, or Firm* — IPUSA, PLLC

(57) ABSTRACT

A shovel includes a traveling lower body; a revolving upper body rotatably installed on the traveling lower body; an object detection device provided on the revolving upper body; a control device provided in the revolving upper body; and an actuator configured to move a driven object, wherein the object detection device is configured to detect an object in a detection space set in surroundings of the shovel, and wherein the control device is configured to allow a motion of the driven object in a direction other than a direction heading for the detected object.

20 Claims, 19 Drawing Sheets

(58) Field of Classification Search
USPC ..... 37/348, 382, 396, 413, 414
See application file for complete search history.

(56) References Cited

U.S. PATENT DOCUMENTS

| | | | | |
|---|---|---|---|---|
| 9,113,047 | B2 * | 8/2015 | Onuma | E02F 9/24 |
| 11,697,920 | B2 * | 7/2023 | Kiyota | E02F 9/26 382/103 |
| 2010/0223008 | A1 * | 9/2010 | Dunbabin | G05D 1/0274 701/301 |
| 2011/0228980 | A1 * | 9/2011 | Ichikawa | H04N 7/181 382/103 |
| 2013/0088593 | A1 * | 4/2013 | Ishimoto | E02F 9/226 348/143 |
| 2013/0147958 | A1 * | 6/2013 | Mitsuta | H04N 23/90 348/148 |
| 2013/0261885 | A1 | 10/2013 | Hargrave, Jr. et al. | |
| 2013/0345939 | A1 * | 12/2013 | Magaki | E02F 9/2075 701/50 |
| 2015/0142276 | A1 * | 5/2015 | Wu | E02F 9/2095 701/50 |
| 2015/0275469 | A1 * | 10/2015 | Fredrickson | E02F 9/265 701/50 |
| 2019/0010675 | A1 * | 1/2019 | Ogawa | E02F 9/2282 |
| 2020/0199851 | A1 * | 6/2020 | Yamamoto | E02F 9/26 |

FOREIGN PATENT DOCUMENTS

| | | |
|---|---|---|
| JP | 2001-262628 | 9/2001 |
| JP | 2007-023486 | 2/2007 |
| JP | 2008-248613 | 10/2008 |
| JP | 2010-198519 | 9/2010 |
| JP | 2011-028729 | 2/2011 |
| JP | 2014-062795 | 4/2014 |
| JP | 2014-181509 | 9/2014 |
| JP | 2015-131371 | 7/2015 |
| JP | 2015-214855 | 12/2015 |
| JP | 2016-176289 | 10/2016 |
| WO | 2012/053105 | 4/2012 |

* cited by examiner

FIG.6

50

| OPERATION \ DETECTION SPACE | R1 | R2 | R3 | R4 | R5 | R6 | R7 | R8 | R9 | R10 | R11 | R12 | R13 | R14 | R15 |
|---|---|---|---|---|---|---|---|---|---|---|---|---|---|---|---|
| RIGHT REVOLUTION | × | × | × | ○ | ○ | × | × | ○ | ○ | ○ | ○ | ○ | ○ | ○ | ○ |
| LEFT REVOLUTION | ○ | × | × | × | ○ | × | × | ○ | ○ | ○ | ○ | ○ | ○ | ○ | ○ |
| FORWARD MOVE | ○ | ○ | ○ | ○ | ○ | ○ | ○ | ○ | × | ○ | ○ | ○ | ○ | ○ | ○ |
| BACKWARD MOVE | ○ | ○ | ○ | ○ | ○ | ○ | ○ | ○ | ○ | × | ○ | ○ | ○ | ○ | ○ |
| BOOM UP | ○ | ○ | ○ | ○ | ○ | ○ | ○ | ○ | ○ | ○ | × | ○ | ○ | ○ | ○ |
| BOOM DOWN | ○ | ○ | ○ | ○ | ○ | ○ | ○ | ○ | ○ | ○ | ○ | × | ○ | × | ○ |
| ARM OPEN | ○ | ○ | ○ | ○ | ○ | ○ | ○ | ○ | ○ | ○ | × | ○ | × | ○ | ○ |
| ARM CLOSE | ○ | ○ | ○ | ○ | ○ | ○ | ○ | ○ | ○ | ○ | ○ | × | ○ | × | ○ |
| BUCKET OPEN | ○ | ○ | ○ | ○ | ○ | ○ | ○ | ○ | ○ | ○ | × | × | × | ○ | ○ |
| BUCKET CLOSE | ○ | ○ | ○ | ○ | ○ | ○ | ○ | ○ | ○ | ○ | ○ | × | ○ | ○ | ○ |

SHOVEL CAPABLE OF PREVENTING MOTION THEREOF FROM BEING UNIFORMLY RESTRICTED

CROSS-REFERENCE TO RELATED APPLICATION

The present application is a continuation application of International Application No. PCT/JP2019/007936 filed on Feb. 28, 2019, which is based on and claims priority to Japanese Patent Application No. 2018-034299 filed on Feb. 28, 2018. The contents of these applications are incorporated herein by reference in their entirety.

BACKGROUND

Technical Field

The present disclosure relates to a shovel.

Description of Related Art

Conventionally, shovels that can be inhibited from operating in the case where it is determined that a person is present in the surroundings, have been known.

However, in the shovels described above, the motion may be uniformly restricted in the case where a person is present in the surroundings.

SUMMARY

According to an embodiment in the present disclosure, a shovel includes a traveling lower body; a revolving upper body rotatably installed on the traveling lower body; an object detection device provided on the revolving upper body; a control device provided in the revolving upper body; and an actuator configured to move a driven object, wherein the object detection device is configured to detect an object in a detection space set in surroundings of the shovel, and wherein the control device is configured to allow a motion of the driven object in a direction other than a direction heading for the detected object.

BRIEF DESCRIPTION OF THE DRAWINGS

FIG. 6 is a diagram illustrating an example of a configuration of a reference table;

DETAILED DESCRIPTION

According to an embodiment in the present disclosure, a shovel is provided, with which it is possible to prevent the motion of the shovel from being uniformly restricted in the case where an object is present in the surroundings of the shovel.

Figure 1:
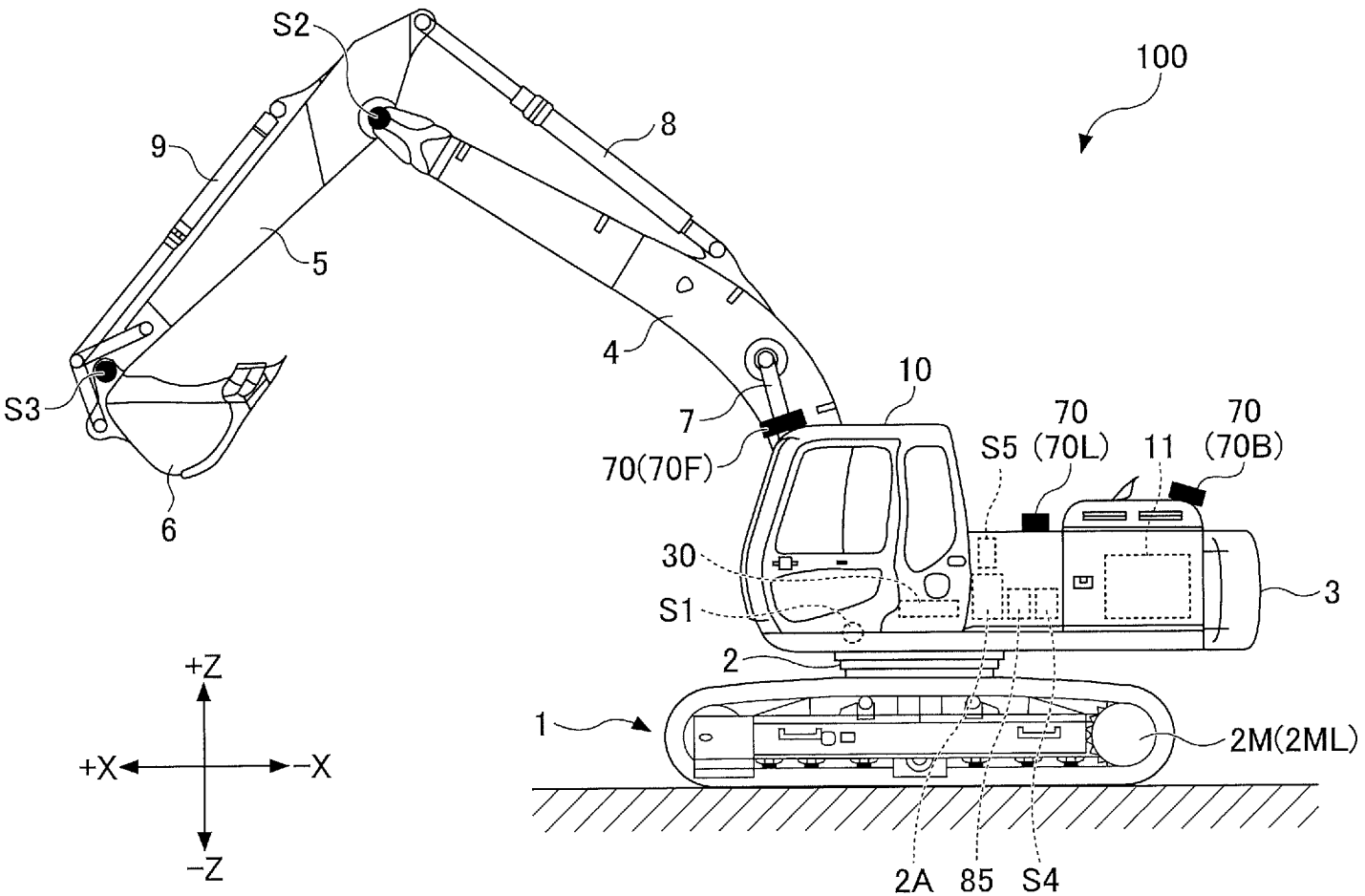
FIG. 1 is a side view of a shovel according to an embodiment in the present disclosure.
Figure 2:
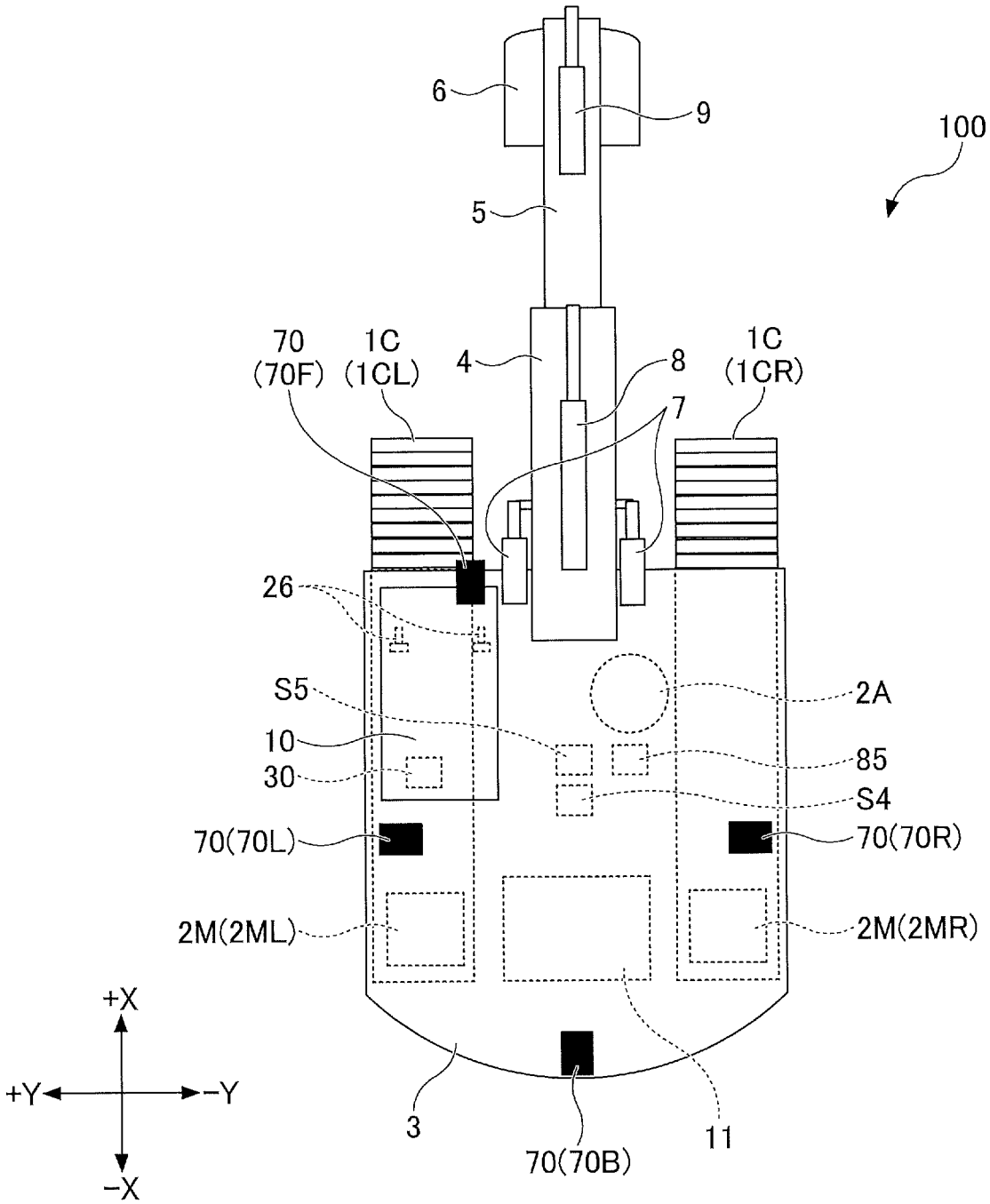
FIG. 2 is a top view of a shovel according to an embodiment in the present disclosure.

First, with reference to FIG. 1 and FIG. 2, a shovel 100 as an excavation machine according to an embodiment in the present disclosure will be described. FIG. 1 is a side view of the shovel 100; and FIG. 2 is a top view of the shovel 100.

In the present embodiment, a traveling lower body 1 of the shovel 100 includes crawlers 1C as driven objects. The crawlers 1C are driven by hydraulic motors for traveling 2M installed in the traveling lower body 1. However, the hydraulic motor for traveling 2M may be a motor-generator for traveling as an electric actuator. Specifically, the crawlers 1C include a left crawler 1CL and a right crawler 1CR. The left crawler 1CL is driven by a left hydraulic motor for traveling 2ML and the right crawler 1CR is driven by a right hydraulic motor for traveling 2MR. The traveling lower body 1 is driven by the crawlers 1C, and hence, functions as a driven object.

On the traveling lower body 1, a revolving upper body 3 is installed, which can be revolved by a revolution mechanism 2. The revolution mechanism 2 as a driven object is driven by a hydraulic motor for revolution 2A installed in the revolving upper body 3. However, the hydraulic motor for revolution 2A may be a motor-generator for revolution as an electric actuator. The revolving upper body 3 is driven by the revolution mechanism 2, and hence, functions as a driven object.

A boom 4 as a driven object is attached to the revolving upper body 3. An arm 5 as a driven object is attached to the tip of the boom 4, and a bucket 6 as a driven object and as an end attachment is attached to the tip of the arm 5. The boom 4, the arm 5, and the bucket 6 constitute an excavation attachment as an example of an attachment. The boom 4 is driven by a boom cylinder 7, the arm 5 is driven by an arm cylinder 8, and the bucket 6 is driven by a bucket cylinder 9.

A boom angle sensor S1 is attached to the boom 4, an arm angle sensor S2 is attached to the arm 5, and a bucket angle sensor S3 is attached to the bucket 6.

The boom angle sensor S1 detects the angle of rotation of the boom 4. In the present embodiment, the boom angle sensor S1 is an acceleration sensor and can detect the boom angle as the angle of rotation of the boom 4 with respect to the revolving upper body 3. The boom angle becomes the minimum angle, for example, when the boom 4 comes to the lowest position, and becomes greater while the boom 4 is raised to a higher position.

The arm angle sensor S2 detects the angle of rotation of the arm 5. In the present embodiment, the arm angle sensor S2 is an acceleration sensor and can detect the arm angle as the angle of rotation of the arm 5 with respect to the boom 4. The arm angle becomes the minimum angle, for example, when the arm 5 is closed most, and becomes greater while the arm 5 is opened wider.

The bucket angle sensor S3 detects the angle of rotation of the bucket 6. In the present embodiment, the bucket angle sensor S3 is an acceleration sensor and can detect the bucket angle as the angle of rotation of the bucket 6 with respect to the arm 5. The bucket becomes the minimum angle, for example, when the bucket 6 is closed most, and becomes greater while the bucket 6 is opened wider.

Each of the boom angle sensor S1, the arm angle sensor S2, and the bucket angle sensor S3 may be a potentiometer using a variable resistor; a stroke sensor for detecting a stroke amount of a corresponding hydraulic cylinder; a rotary encoder for detecting an angle of rotation around a coupling pin; a gyro sensor; a combination of an acceleration sensor and a gyro sensor; or the like.

The revolving upper body 3 is provided with a cabin 10 as the driver's cab, and has a power source such as an engine 11 installed. Also, a controller 30, an object detection device 70, an orientation detection device 85, a machine tilt sensor S4, a revolutional angular velocity sensor S5, and the like are attached to the revolving upper body 3. An operation device 26 and the like are provided in the interior of the cabin 10. Note that in the present description, for the sake of convenience, a side of the revolving upper body 3 on which the boom 4 is attached is defined as the forward direction, and the side on which the counterweight is attached is defined as the backward direction.

The controller 30 is a control device for controlling the shovel 100. In the present embodiment, the controller 30 is constituted with a computer that includes a CPU, a RAM, an NVRAM, a ROM, and the like. Also, the controller 30 reads a program corresponding to various functions from the ROM to load the program in the RAM, and causes the CPU to execute the corresponding processing.

The object detection device 70 is configured to detect an object present in the surroundings of the shovel 100. The object may be, for example, a person, an animal, a vehicle, a construction machine, a building, a hole, or the like. The object detection device 70 is, for example, an ultrasonic sensor, a millimeter-wave radar, a monocular camera, a stereo camera, a LIDAR, a range image sensor, an infrared sensor, or the like. In the present embodiment, the object detection device 70 includes a forward sensor 70F attached to the front end on the upper surface of the cabin 10; a backward sensor 70B attached to the rear end on the upper surface of the revolving upper body 3; a left sensor 70L attached to the left end on the upper surface of the revolving upper body 3; and a right sensor 70R attached to the right end on the upper surface of the revolving upper body 3. The object detection device 70 may be configured to detect a predetermined object present within a predetermined region set in the surroundings of the shovel 100. For example, the object detection device 70 may be configured to distinguish a person from an object other than a person.

The orientation detection device 85 is configured to detect information on the relative relationship between the orientation of the revolving upper body 3 and the orientation of the traveling lower body 1 (hereafter, referred to as "information on the orientation"). For example, the orientation detection device 85 may be constituted with a combination of a geomagnetic sensor attached to the traveling lower body 1 and a geomagnetic sensor attached to the revolving upper body 3. Alternatively, the orientation detection device 85 may be constituted with a combination of a GNSS receiver attached to the traveling lower body 1 and a GNSS receiver attached to the revolving upper body 3. In a configuration where the revolving upper body 3 is driven to perform revolutions by a motor generator for revolutions, the orientation detection device 85 may be constituted with a resolver. The orientation detection device 85 may be arranged, for example, in a center joint provided in connection with the revolution mechanism 2 to implement relative revolution between the traveling lower body 1 and the revolving upper body 3.

The machine tilt sensor S4 is configured to detect the tilt of the revolving upper body 3 with respect to a predetermined plane. In the present embodiment, the machine tilt sensor S4 is an acceleration sensor to detect the tilt angle around the front-and-back axis and the tilt angle around the right-and-left axis of the revolving upper body 3 with respect to the horizontal plane. The front-and-back axis and the right-and-left axis of the revolving upper body 3 are, for example, orthogonal to each other, and pass through the center point of the shovel as a point along the pivot of the shovel 100.

The revolutional angular velocity sensor S5 is configured to detect the revolutional angular velocity of the revolving upper body 3. In the present embodiment, the revolutional angular velocity sensor S5 is a gyro sensor. The revolutional angular velocity sensor S5 may be a resolver, a rotary encoder, or the like. The revolutional angular velocity sensor S5 may detect the revolutional velocity. The revolutional velocity may be calculated from the revolutional angular velocity.

In the following, any combination of the boom angle sensor S1, the arm angle sensor S2, the bucket angle sensor S3, the machine tilt sensor S4, and the revolutional angular velocity sensor S5 is collectively referred to as the positional sensor(s).

Figure 3:
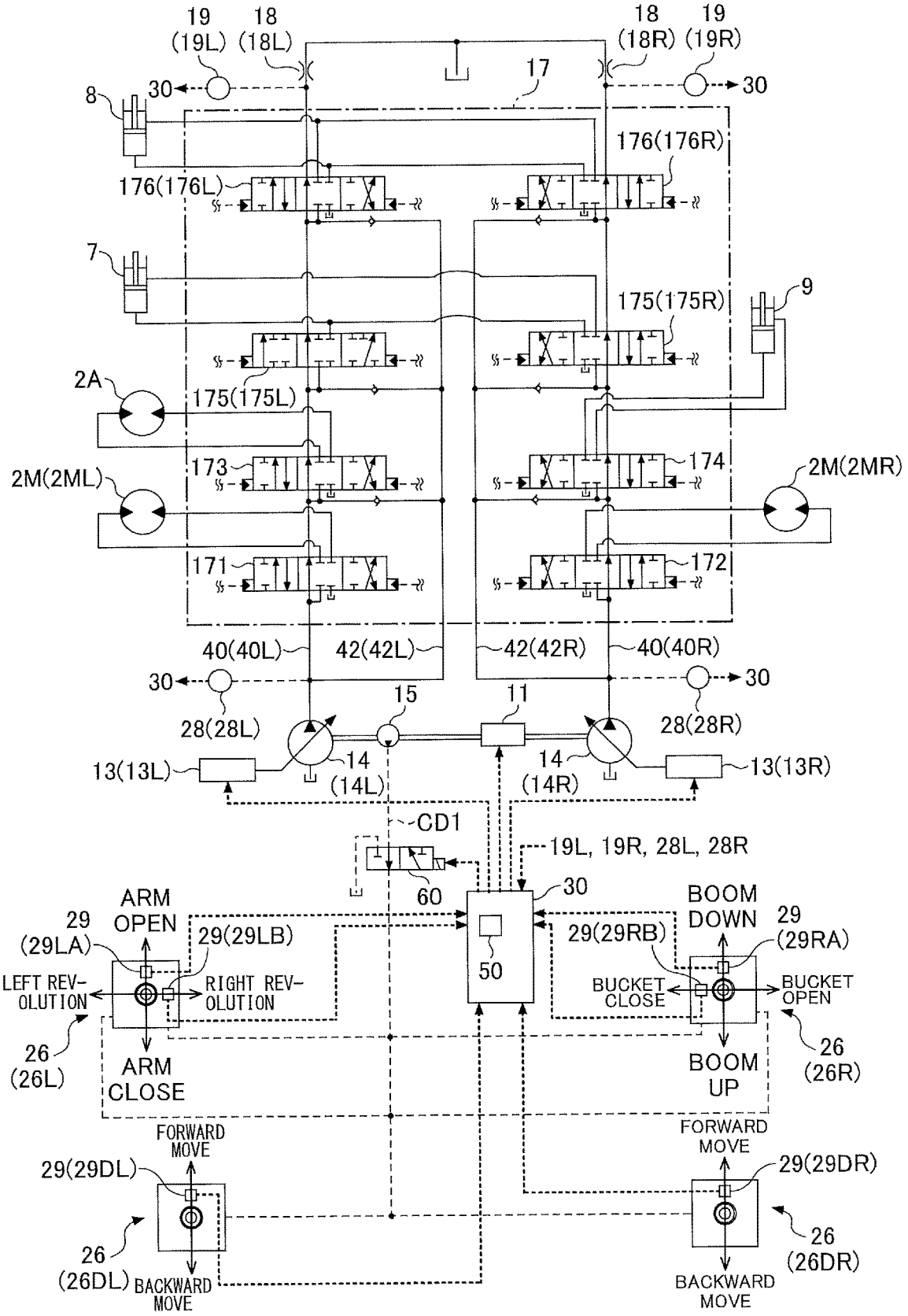
FIG. 3 is a diagram illustrating an example of a configuration of a hydraulic system installed in a shovel.

Next, with reference to FIG. 3, an example of a configuration of a hydraulic system installed in the shovel 100 will be described. FIG. 3 is a diagram illustrating an example of a configuration of a hydraulic system installed in the shovel 100. In FIG. 3, a mechanical power transmission system, hydraulic oil lines, pilot lines, and an electrical control system are designated with double lines, solid lines, dashed lines, and dotted lines, respectively.

The hydraulic system of the shovel 100 primarily includes an engine 11, regulators 13, main pumps 14, a pilot pump 15, control valves 17, an operation device 26, discharge pressure sensors 28, operational pressure sensors 29, a controller 30, and control valves 60.

In FIG. 3, the hydraulic system circulates hydraulic oil from the main pumps 14, which is driven by the engine 11, to the hydraulic oil tank via center bypass pipelines 40 or parallel pipelines 42.

The engine 11 is the driving source of the shovel 100. In the present embodiment, the engine 11 is, for example, a diesel engine that operates to maintain a predetermined number of revolutions. The output shaft of the engine 11 is coupled with the respective input shafts of the main pumps 14 and the pilot pump 15.

The main pump 14 is configured to supply hydraulic oil to the control valves 17 via hydraulic oil lines. In the present embodiment, the main pump 14 is a swashplate-type, variable-capacity hydraulic pump. The regulator 13 is configured to control the discharge amount of the main pump 14. In the present embodiment, according to a control command from the controller 30, the regulator 13L adjusts the tilt angle of the swashplate of the main pump 14, so as to control the discharge amount (displacement volume) of the main pump 14.

The pilot pump 15 is configured to supply hydraulic oil to a hydraulic control device including the operation device 26 via the pilot lines. In the present embodiment, the pilot pump 15 is a fixed-capacity hydraulic pump. However, the pilot pump 15 may be omitted. In this case, the functions implemented by the pilot pump 15 may be implemented by the main pumps 14. In other words, in addition to the function of supplying hydraulic oil to the control valves 17, the main pumps 14 may include a function of supplying hydraulic oil to the operation device 26, a proportional valve 31, and the like after lowering the pressure of the hydraulic oil by a throttle or the like.

The control valves 17 are hydraulic control devices that control the hydraulic system in the shovel 100. In the present embodiment, the control valves 17 include control valves 171 to 176. The control valves 175 include a control valve 175L and a control valve 175R, and the control valves 176 include a control valve 176L and a control valve 176R. The control valves 17 can selectively supply hydraulic oil discharged by the main pumps 14 to one or more hydraulic actuators through the control valves 171 to 176. The control valves 171 to 176 control the flow rate of the hydraulic oil flowing from the main pumps 14 to the hydraulic actuators, and the flow rate of the hydraulic oil flowing from the hydraulic actuators to the hydraulic oil tank. The hydraulic actuators include the boom cylinder 7, the arm cylinder 8, the bucket cylinder 9, the left hydraulic motor for traveling 2ML, the right hydraulic motor for traveling 2MR, and the hydraulic motor for revolution 2A.

The operation device 26 is a device used by the operator for operating the actuators. The actuators include at least one of a hydraulic actuator and an electric actuator. In the present embodiment, the operation device 26 supplies, via the pilot lines, hydraulic oil discharged by the pilot pump 15 to the pilot port of a corresponding control valve among the control valves 17. The pressure (pilot pressure) of the hydraulic oil supplied to each of the pilot ports is a pressure depending on the operational direction and the operational amount of a lever or pedal (not illustrated) of the operation device 26 corresponding to each of the hydraulic actuators. The discharge pressure sensors 28 are configured to detect the discharge pressure of the main pumps 14. In the present embodiment, the discharge pressure sensors 28 output the detected values to the controller 30.

The operational pressure sensors 29 are configured to detect the contents of an operation performed by the operator on the operation device 26. In the present embodiment, each of the operational pressure sensors 29 detects the operational direction and the operational amount of the lever or pedal of the operation device 26 corresponding to one of the actuators in the form of pressure (hydraulic pressure) and outputs the detected value to the controller 30. The contents of an operation on the operation device 26 may be detected using sensors other than the operational pressure sensors.

The main pumps 14 include a left main pump 14L and a right main pump 14R. Here, the left main pump 14L circulates hydraulic oil through a left center bypass pipeline 40L or a left parallel pipeline 42L to the hydraulic oil tank, and the right main pump 14R circulates hydraulic oil through a right center bypass pipeline 40R or a right parallel pipeline 42R to the hydraulic oil tank.

The left center bypass pipeline 40L is a hydraulic oil line passing through the control valves 171, 173, 175L, and 176L arranged among the control valves 17. The right center bypass pipeline 40R is a hydraulic oil line passing through the control valves 172, 174, 175R, and 176R arranged among the control valves 17.

The control valve 171 is a spool valve to supply hydraulic oil discharged by the left main pump 14L to the left hydraulic motor for traveling 2ML, and to switch the flow of hydraulic oil discharged by the left hydraulic motor for traveling 2ML so as to discharge the hydraulic oil into the hydraulic oil tank.

The control valve 172 is a spool valve to supply hydraulic oil discharged by the right main pump 14R to the right hydraulic motor for traveling 2MR, and to switch the flow of hydraulic oil discharged by the right hydraulic motor for traveling 2MR so as to discharge the hydraulic oil into the hydraulic oil tank.

The control valve 173 is a spool valve to supply hydraulic oil discharged by the left main pump 14L to the hydraulic motor for revolution 2A, and to switch the flow of hydraulic oil discharged by the hydraulic motor for revolution 2A so as to discharge the hydraulic oil into the hydraulic oil tank.

The control valve 174 is a spool valve to supply hydraulic oil discharged by the right main pump 14R to the bucket cylinder 9, and to switch the flow of hydraulic oil in the bucket cylinder 9 so as to discharge the hydraulic oil into the hydraulic oil tank.

The control valve 175L is a spool valve to switch the flow of hydraulic oil so as to supply hydraulic oil discharged by the left main pump 14L to the boom cylinder 7. The control valve 175R is a spool valve to supply hydraulic oil discharged by the right main pump 14R to the boom cylinder 7, and to switch the flow of hydraulic oil in the boom cylinder 7 so as to discharge the hydraulic oil into the hydraulic oil tank.

The control valve 176L is a spool valve to supply hydraulic oil discharged by the left main pump 14L to the arm cylinder 8, and to switch the flow of hydraulic oil in the arm cylinder 8 so as to discharge the hydraulic oil into the hydraulic oil tank.

The control valve 176R is a spool valve to supply hydraulic oil discharged by the right main pump 14R to the arm cylinder 8, and to switch the flow of hydraulic oil in the arm cylinder 8 so as to discharge the hydraulic oil into the hydraulic oil tank.

The left parallel pipeline 42L is a hydraulic oil line parallel to the left center bypass pipeline 40L. The left parallel pipeline 42L can provide hydraulic oil to a downstream control valve in the case where the flow of hydraulic oil through the left center bypass pipeline 40L is restricted or cut off by one of the control valves 171, 173, and 175L. The right parallel pipeline 42R is a hydraulic oil line parallel to the right center bypass pipeline 40R. The right parallel pipeline 42R can provide hydraulic oil to a downstream control valve in the case where the flow of hydraulic oil through the right center bypass pipeline 40R is restricted or cut off by one of the control valves 172, 174, and 175R.

The regulators 13 include a left regulator 13L and a right regulator 13R. Depending on the discharge pressure of the left main pump 14L, the left regulator 13L adjusts the tilt angle of the swashplate of the left main pump 14L, so as to control the discharge amount (displacement volume) of the left main pump 14L. Specifically, the left regulator 13L adjusts the tilt angle of the left main pump 14L, for example, in response to an increase in the discharge pressure of the left main pump 14L, so as to reduce the discharge amount (displacement volume). The same applies to the right regulator 13R. This is to control the absorbed horsepower of the main pump 14, which is expressed by a product of the discharge pressure and the discharge volume, so as not to exceed the output horsepower of the engine 11.

The operation device 26 include a left operation lever 26L, a right operation lever 26R, and traveling levers 26D. The traveling levers 26D include a left traveling lever 26DL and a right traveling lever 26DR.

The left operation lever 26L is used for a revolution operation and an operation of the arm 5. When the left operation lever 26L is operated in the front-and-back direction, hydraulic oil discharged by the pilot pump 15 is used for introducing a control pressure according to the operational amount of the lever into the pilot port of the control valve 176. Also, when operated in the right-and-left direction, hydraulic oil discharged by the pilot pump 15 is used for introducing a control pressure according to the operational amount of the lever into the pilot port of the control valve 173.

Specifically, when operated in the arm-closing direction, the left operation lever 26L introduces hydraulic oil into the right pilot port of the control valve 176L, and introduces hydraulic oil into the left pilot port of the control valve 176R. Also, when operated in the arm-opening direction, the left operation lever 26L introduces hydraulic oil into the left pilot port of the control valve 176L, and introduces hydraulic oil into the right pilot port of the control valve 176R. Also, when operated in the left-revolution direction, the left operation lever 26L introduces hydraulic oil into the left pilot port of the control valve 173, and when operated in the right-revolution direction, introduces hydraulic oil into the right pilot port of the control valve 173.

The right operation lever 26R is used for an operation of the boom 4 and an operation of the bucket 6. When the right operation lever 26R is operated in the front-and-back direction, hydraulic oil discharged by the pilot pump 15 is used for introducing a control pressure according to the operational amount of the lever into the pilot port of the control valve 175. Also, when operated in the right-and-left direction, hydraulic oil discharged by the pilot pump 15 is used for introducing a control pressure according to the operational amount of the lever into the pilot port of the control valve 174.

Specifically, when operated in the boom-down direction, the right operation lever 26R introduces hydraulic oil into the right pilot port of the control valve 175R. Also, when operated in the boom-up direction, the right operation lever 26R introduces hydraulic oil into the right pilot port of the control valve 175L, and introduces hydraulic oil into the left pilot port of the control valve 175R. Also, when operated in the bucket-closing direction, the right operation lever 26R introduces hydraulic oil into the right pilot port of the control valve 174, and when operated in the bucket-opening direction, introduces hydraulic oil into the left pilot port of the control valve 174.

The traveling levers 26D are used for operations of the crawlers 1C. Specifically, the left traveling lever 26DL is used for an operation of the left crawler 1CL. The left traveling lever 26DL may be configured to be operable together with the left traveling pedal. When the left traveling lever 26DL is operated in the front-and-back direction, hydraulic oil discharged by the pilot pump 15 is used for introducing a control pressure according to the operational amount of the lever into the pilot port of the control valve 171. The right traveling lever 26DR is used for an operation of the right crawler 1CR. The right traveling lever 26DR may be configured to be operable together with the right traveling pedal. When the right traveling lever 26DR is operated in the front-and-back direction, hydraulic oil discharged by the pilot pump 15 is used for introducing a control pressure according to the operational amount of the lever into the pilot port of the control valve 172.

The discharge pressure sensors 28 include a discharge pressure sensor 28L and a discharge pressure sensor 28R. The discharge pressure sensor 28L detects the discharge pressure of the left main pump 14L, and outputs the detected value to the controller 30. The same applies to the discharge pressure sensor 28R.

The operational pressure sensors 29 include operational pressure sensors 29LA, 29LB, 29RA, 29RB, 29DL, and 29DR. The operational pressure sensor 29LA detects the contents of an operation in the front-and-back direction performed by the operator on the left operation lever 26L in the form of pressure, and outputs the detected value to the controller 30. The contents of an operation include, for example, the operational direction of the lever and the operational amount of the lever (the operation angle of the lever).

Similarly, the operational pressure sensor 29LB detects the contents of an operation in the right-and-left direction performed by the operator on the left operation lever 26L in the form of pressure, and outputs the detected value to the controller 30. The operational pressure sensor 29RA detects the contents of an operation in the front-and-back direction performed by the operator on the right operation lever 26R in the form of pressure, and outputs the detected value to the controller 30. The operational pressure sensor 29RB detects the contents of an operation in the right-and-left direction performed by the operator on the right operation lever 26R in the form of pressure, and outputs the detected value to the controller 30. The operational pressure sensor 29DL detects the contents of an operation in the front-and-back direction performed by the operator on the left traveling lever 26DL in the form of pressure, and outputs the detected value to the controller 30. The operational pressure sensor 29DR detects the contents of an operation in the front-and-back direction performed by the operator on the right traveling lever 26DR in the form of pressure, and outputs the detected value to the controller 30.

The controller 30 receives the output of the operational pressure sensors 29, and outputs a control command to the regulators 13 when necessary, to vary the discharge amount of the main pumps 14. Here, negative control using throttles 18 and control pressure sensors 19 will be described. The throttles 18 include a left throttle 18L and a right throttle 18R, and the control pressure sensors 19 include a left control pressure sensor 19L and a right control pressure sensor 19R.

Along the left center bypass pipeline 40L, the left throttle 18L is arranged between the control valve 176L located most downstream, and the hydraulic oil tank. Therefore, the flow of hydraulic oil discharged by the left main pump 14L is restricted by the left throttle 18L. In addition, the left throttle 18L generates a control pressure for controlling the left regulator 13L. The left control pressure sensor 19L is a sensor for detecting this control pressure, and outputs a detected value to the controller 30. In response to this control pressure, the controller 30 adjusts the tilt angle of the swashplate of the left main pump 14L, so as to control the discharge amount of the left main pump 14L. The controller 30 reduces the discharge amount of the left main pump 14L to be smaller while the control pressure becomes greater, and increases the discharge amount of the left main pump 14L to be greater while the control pressure becomes smaller. The controller 30 also controls the discharge amount of the right main pump 14R in substantially the same way.

Specifically, as illustrated in FIG. 3, in a stand-by state where none of the hydraulic actuators in the shovel 100 is operated, hydraulic oil discharged by the left main pump 14L reaches the left throttle 18L through the left center bypass pipeline 40L. Also, the flow of hydraulic oil discharged by the left main pump 14L increases the control pressure generated upstream of the left throttle 18L. As a result, the controller 30 reduces the discharge amount of the left main pump 14L down to the minimum allowable discharge amount, to control pressure loss (pumping loss) when the discharged hydraulic oil passes through the left center bypass pipeline 40L. On the other hand, in the case where one of the hydraulic actuators is operated, the hydraulic oil discharged by the left main pump 14L flows into the hydraulic actuator through a control valve corresponding to the hydraulic actuator to be operated. Then, the flow of hydraulic oil discharged by the left main pump 14L reduces or eliminates the amount to reach the left throttle 18L, which reduces the control pressure generated upstream of the left throttle 18L. As a result, the controller 30 increases the discharge amount of the left main pump 14L, to cause a sufficient amount of hydraulic oil to flow into the hydraulic actuator to be operated, so as to surely drive the hydraulic actuator to be operated. Note that the controller 30 also controls the discharge amount of the right main pump 14R in substantially the same way.

With the configuration as described above, the hydraulic system in FIG. 3 can reduce wasteful energy consumption in the main pumps 14 in a stand-by state. The wasteful energy consumption includes a pumping loss generated by hydraulic oil discharged by the main pumps 14 in the center bypass pipelines 40. Also, in the case of operating a hydraulic actuator, the hydraulic system in FIG. 3 can securely supply the necessary and sufficient hydraulic oil from the main pump 14 to the hydraulic actuator to be operated.

The control valve 60 is configured to switch the operation device 26 between an enabled state and a disabled state. The enabled state of the operation device 26 is a state in which the operator can move a relevant driven object by operating the operation device 26, and the disabled state of the operation device 26 is a state in which the operator cannot move a relevant driven object even if operating the operation device 26.

In the present embodiment, the control valve 60 is a solenoid valve capable of switching a pilot line CD1 between a communicating state and a cut-off state, which connects the pilot pump 15 to the operation device 26. Specifically, the control valve 60 is configured to switch the pilot line CD1 between a communicating state and a cut-off state in response to a command from the controller 30.

The control valve 60 may be configured to be operable together with a gate lock lever, which is not illustrated. Specifically, the control valve 60 may be configured to cause the pilot line CD1 to transition to a cut-off state when the gate lock lever is pressed down, and to cause the pilot line CD1 to transition to a communicating state when the gate lock lever is pulled up. However, the control valve 60 may be a solenoid valve separate from a solenoid valve that is capable of switching the pilot line CD1 between a communicating state and a cut-off state operating together with the gate lock lever.

Figure 4:
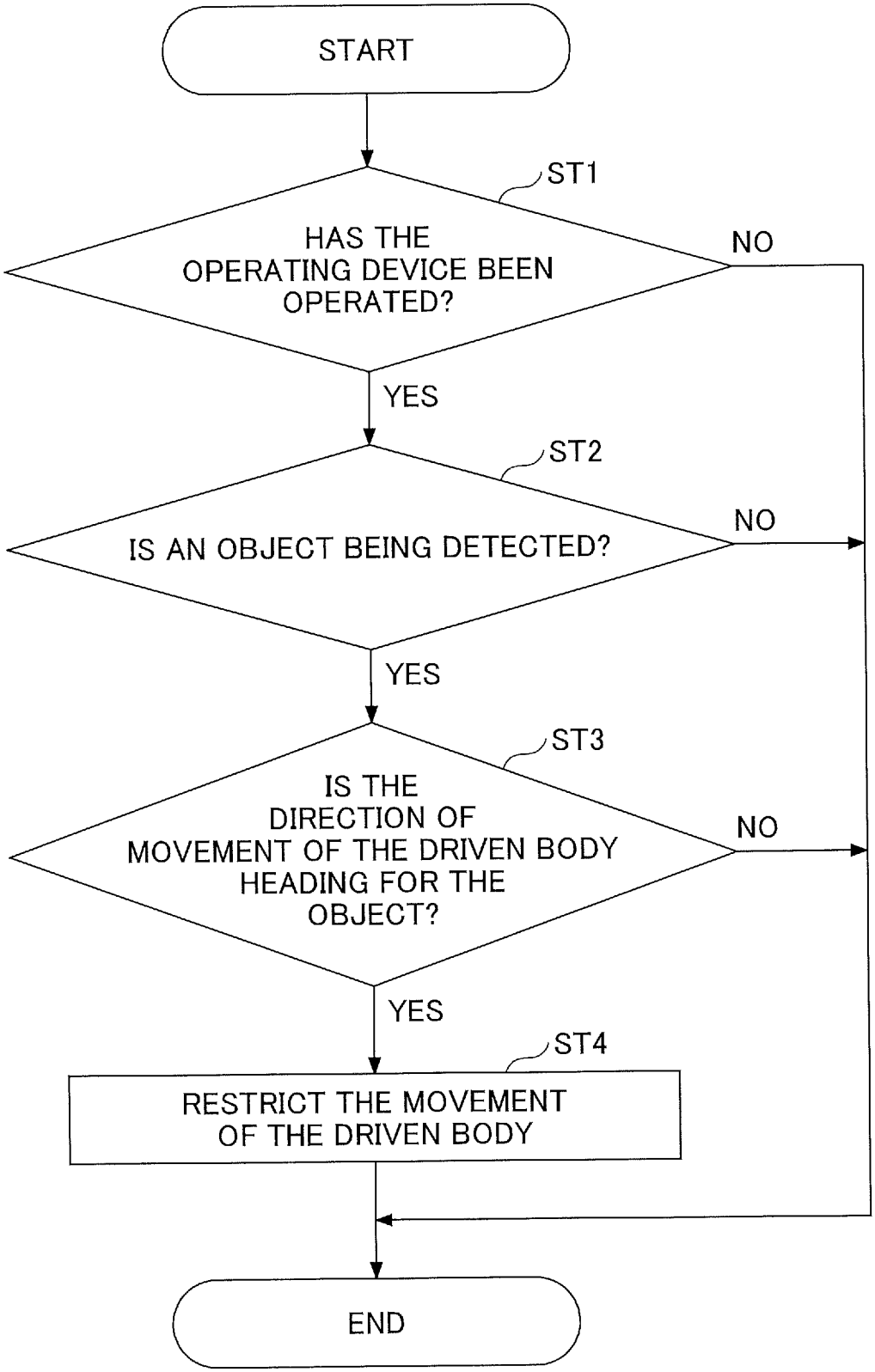
FIG. 4 is a flow chart illustrating an example of an operation restriction process.

Next, with reference to FIG. 4, a process in which the controller 30 restricts the motion of a driven object (hereafter, referred to as "operation restriction process") will be described. FIG. 4 is a flow chart illustrating an example of an operation restriction process. The controller 30 repeatedly performs this operation restriction process at predetermined control cycles.

First, at Step ST1, the controller 30 determines whether the operation device 26 is operated. In the present embodiment, the controller 30 determines whether the operation device 26 is operated, based on the output of the operational pressure sensors 29. For example, based on the output of the operational pressure sensor 29LA, the controller 30 determines whether an arm-closing operation is performed, and whether the arm-opening operation is performed; and based on the output of the operational pressure sensor 29LB, determines whether a left revolution operation is performed, and whether a right revolution operation is performed. Alternatively, based on the output of the operational pressure sensor 29RA, the controller 30 determines whether a boom-up operation is performed, and whether the boom-down operation is performed; and based on the output of the operational pressure sensor 29RB, determines whether a bucket-closing operation is performed, and whether a bucket-opening operation is performed. Similarly, based on the output of the operational pressure sensor 29DL, the controller 30 determines whether a forward move operation of the left crawler 1CL is performed, and whether the backward move operation of the left crawler 1CL is performed; and based on the output of the operational pressure sensor 29DR, determines whether a forward move operation of the right crawler 1CR is performed, and whether a backward move operation of the right crawler 1CR is performed.

If it is determined that the operation device 26 is not operated (NO at Step ST1), the controller 30 terminates the current operation restriction process.

If it is determined that the operation device 26 is operated (YES at Step ST1), at Step ST2, the controller 30 determines whether an object is being detected. In the present embodiment, the controller 30 determines whether an object is being detected in a predetermined detection space based on the output of the object detection device 70.

If it is determined that an object is not detected (NO at Step ST2), the controller 30 terminates the current operation restriction process. If it is determined that an object is being detected (YES at Step ST2), at Step ST3, the controller 30 determines whether the operational direction of the driven object is coincident with a direction heading for the object. In other words, the controller 30 determines whether the driven object approaches the object by moving the driven object. This is to determine whether there is a risk of the shovel 100 coming into contact with the object.

In the present embodiment, the controller 30 refers to a reference table 50 (see FIG. 6) stored in the ROM, to determine whether a driven object approaches the object in the case of moving the driven object in response to an operation on the operation device 26. The reference table 50 stores detection spaces in which an object may be present; contents of operations of driven objects; and the relationship between an object and a driven object whether to approach each other when driving the driven object, in a format that can be referenced. If the controller 30 can identify the contents of an operation of a driven object and a detection space in which an object is present, by referring to the reference table 50, the controller 30 can determine whether the object and the driven object approach each other.

If it is determined that the operational direction of the driven object is not coincident with a direction heading for the object (NO at Step ST3), the controller 30 terminates the current operation restriction process. If it is determined that the operational direction of the driven object is coincident with a direction heading for the object (YES at Step ST3), at Step ST4, the controller 30 restricts the motion of the driven object. In the present embodiment, the controller 30 starts braking the driven object if the driven object is already moving, or inhibits the driven object from moving if the driven object is not yet moving.

With this configuration, the controller 30 allows the motion of a driven object when the driven object is operated in a direction away from an object, even in the case where the object is detected in a detection space. Therefore, it is possible to avoid uniformly restricting the motion of the shovel 100 when an object is detected in the detection space.

Figure 5A:
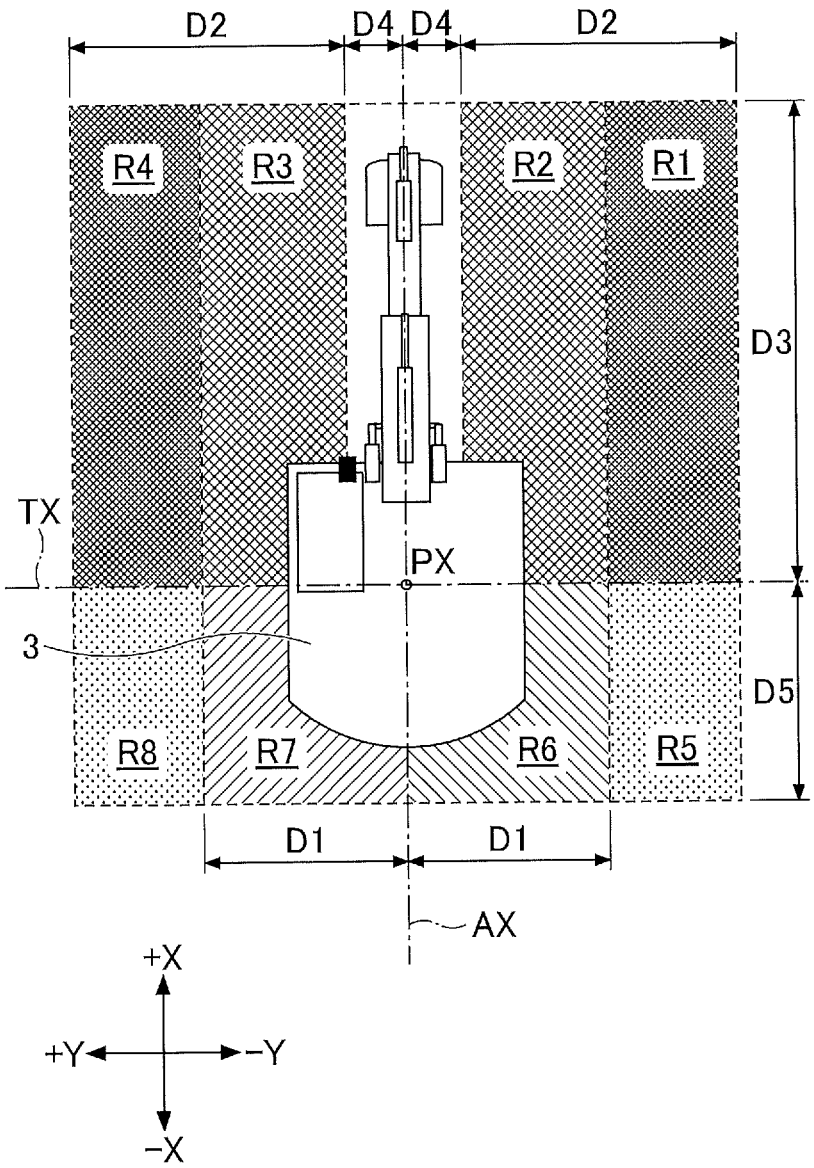
FIG. 5A illustrates an example of settings of detection spaces.
Figure 5B:
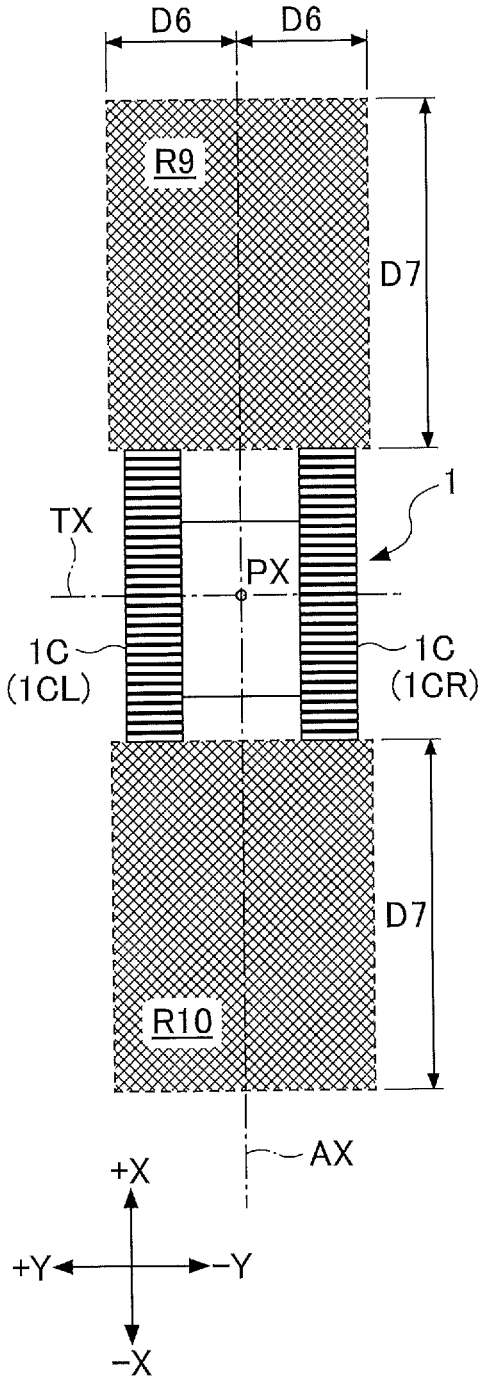
FIG. 5B illustrates an example of settings of detection spaces.
Figure 5C:
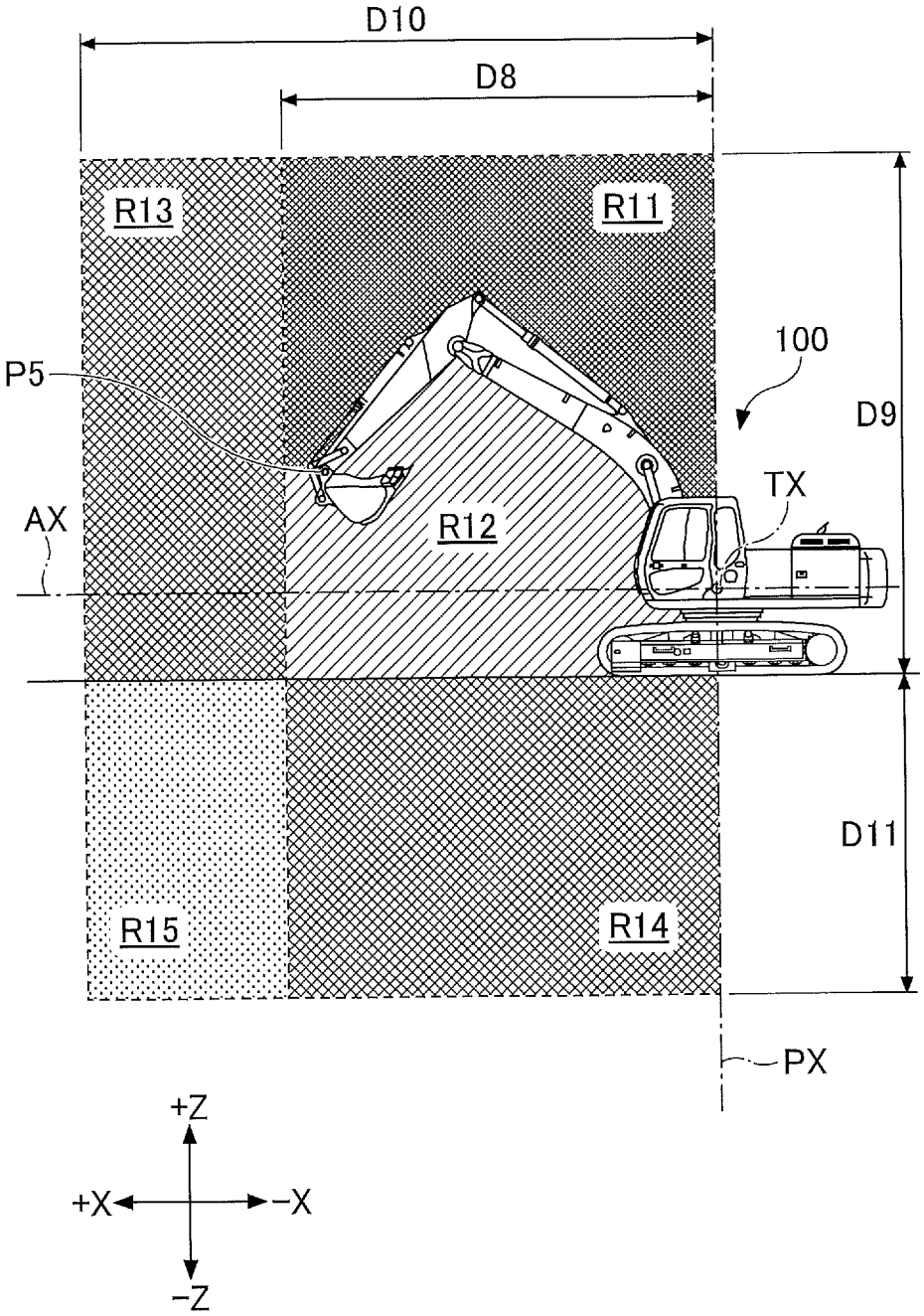
FIG. 5C illustrates an example of settings of detection spaces.

Next, with reference to FIGS. 5A to 5C, detection spaces will be described. FIG. 5A to FIG. 5C illustrate an example of settings of detection spaces. Specifically, FIG. 5A is a top view of the revolving upper body 3 illustrating the detection spaces with respect to the revolving upper body 3. FIG. 5B is a top view of the traveling lower body 1 illustrating the detection spaces with respect to the traveling lower body 1. FIG. 5C is a left side view of the shovel 100 illustrating the detection spaces with respect to the excavation attachment. In each of FIGS. 5A to 5C, the axis PX represents the pivot of the shovel 100, the axis AX represents the front-and-back axis of the shovel 100, and the axis TX represents the right-and-left axis of the shovel 100.

As illustrated in FIGS. 5A to 5C, 15 detection spaces, including a first space R1 to a fifteenth space R15 space, are set in the surroundings of the shovel 100 in the present embodiment.

The first space R1 to the eighth space R8 are detection spaces with respect to the revolving upper body 3. In the present embodiment, the first space R1 to the eighth space R8 have a predetermined height (e.g., 3 meters). The predetermined height may be the maximum height of the current excavation attachment derived based on the output of the positional sensor.

The first space R1 is set to have a range on the right side (−Y side) of the axis AX, from the right end of an interval D1 to the right end of an interval D2; and a range on the front side (+X side) of the axis TX, from the axis TX to the front end of an interval D3. The interval D1 is, for example, longer than the interval from the axis PX to the rear end of the revolving upper body 3 (counterweight). The interval D2 and the interval D3 are values based on, for example, the maximum radius of revolution of the excavation attachment. The interval D2 and the interval D3 may be given by a function having as an argument the current radius of revolution of the excavation attachment. The interval D3 is desirably longer than the interval D2. An object present in the first space R1 has a risk of coming into contact with the excavation attachment, for example, when the revolving upper body 3 makes a right revolution.

The second space R2 is set to have a range on the right side (−Y side) of the axis AX, from the right end of an interval D4 to the right end of the interval D1; and a range on the front side (+X side) of the axis TX, from the axis TX to the front end of the interval D3. The interval D4 is, for example, longer than an interval from the axis AX to the side end of the bucket 6. An object present in the second space R2 has a risk of coming into contact with the excavation attachment or the revolving upper body 3, for example, when the revolving upper body 3 makes a right or left revolution. The second space R2 is set to cover a space in which there is a risk of getting entangled in the side part and the front part of the revolving upper body 3 when the revolving upper body 3 makes a revolution.

The third space R3 is set to have a range on the left side (+Y side) of the axis AX, from the left end of another interval D4 to the left end of another interval D1; and a range on the front side (+X side) of the axis TX, from the axis TX to the front end of the interval D3. An object present in the third space R3 has a risk of coming into contact with the excavation attachment or the revolving upper body 3, for example, when the revolving upper body 3 makes a left or right revolution. The third space R3 is set to cover a space in which there is a risk of getting entangled in the side part and the front part of the revolving upper body 3 when the revolving upper body 3 makes a revolution.

The fourth space R4 is set to have a range on the left side (+Y side) of the axis AX, from the right end of the other interval D1 to the right end of another interval D2; and a range on the front side (+X side) of the axis TX, from the axis TX to the front end of the interval D3. An object present in the fourth space R4 has a risk of coming into contact with the excavation attachment, for example, when the revolving upper body 3 makes a left revolution.

The fifth space R5 is set to have a range on the right side (−Y side) of the axis AX, from the right end of the interval D1 to the right end of the interval D2; and a range on the rear side (−X side) of the axis TX, from the axis TX to the rear end of the interval D5. The interval D5 is a value based on, for example, the maximum radius of revolution of the excavation attachment; or may be given by a function having as an argument the current radius of revolution of the excavation attachment. The interval D5 is desirably shorter than the interval D3. This is because the fifth space R5 is set further away from the excavation attachment than the first space R1 in the right-revolution direction. An object present in the fifth space R5 has a risk of coming into contact with the excavation attachment, for example, when the revolving upper body 3 makes a right revolution.

The sixth space R6 is set to have a range on the right side (−Y side) of the axis AX, from the axis AX to the right end of the interval D1; and a range on the rear side (−X side) of the axis TX, from the axis TX to the rear end of the interval D5. An object present in the sixth space R6 has a risk of coming into contact with the excavation attachment or the revolving upper body 3, for example, when the revolving upper body 3 makes a right or left revolution. The sixth space R6 is set to cover a space in which there is a risk of getting entangled in the side part and the rear part of the revolving upper body 3 when the revolving upper body 3 makes a revolution.

The seventh space R7 is set to have a range on the left side (+Y side) of the axis AX, from the axis AX to the left end of the other interval D1; and a range on the rear side (−X side) of the axis TX, from the axis TX to the rear end of the interval D5. An object present in the seventh space R7 has a risk of coming into contact with the excavation attachment or the revolving upper body 3, for example, when the revolving upper body 3 makes a left or right revolution. The seventh space R7 is set to cover a space in which there is a risk of getting entangled in the side part and the rear part of the revolving upper body 3 when the revolving upper body 3 makes a revolution.

The eighth space R8 is set to have a range on the left side (+Y side) of the axis AX, from the left end of the other interval D1 to the left end of the other interval D2; and a range on the rear side (−X side) of the axis TX, from the axis TX to the rear end of the interval D5. An object present in the eighth space R8 has a risk of coming into contact with the excavation attachment, for example, when the revolving upper body 3 makes a left revolution.

The ninth space R9 and the tenth space R10 are detection spaces with respect to the traveling lower body 1. In the present embodiment, the ninth space R9 and the tenth space R10 have a predetermined height (e.g., 3 meters). The predetermined height may be the maximum height of a current excavation attachment derived based on the output of the positional sensor. The ninth space R9 and the tenth space R10 may be set dynamically based on the current orientation of the traveling lower body 1 with respect to the revolving upper body 3.

The ninth space R9 is set to have a range on both the right side (−Y side) and the left side (+Y side) of the axis AX, from the axis AX to the right and left ends of intervals D6; and a range on the front side (the +X side) of the crawlers 1C from the front end (the end on the +X side) of the crawlers 1C to the front end of an interval D7. The interval D6 is, for example, longer than an interval from the axis AX to the side end of the crawlers 1C. The interval D7 is, for example, longer than the length of the crawlers 1C (the interval from the front end to the rear end). An object present in the ninth space R9 has a risk of coming into contact with the traveling lower body 1, for example, when the traveling lower body 1 moves forward.

The tenth space R10 is set to have a range on both the right side (−Y side) and the left side (+Y side) of the axis AX, from the axis AX to the right and left ends of the intervals D6; and a range on the rear side (the −X side) of the crawlers 1C, from the rear end (the end on the −X side) of the crawlers 1C to the rear end of the interval D7. An object present in the tenth space R10 has a risk of coming into contact with the traveling lower body 1, for example, when the traveling lower body 1 moves backward.

Each of the first space R1 to the eighth space R8 as the detection spaces with respect to the revolving upper body 3 may at least partially overlap one of the ninth space R9 and the tenth space R10 as the detection spaces with respect to the traveling lower body 1. For example, each of the first space R1 and the second space R2 may overlap the ninth space R9, or may overlap the tenth space R10. Therefore, an object detected in the first space R1 may be detected in the ninth space R9, or may be detected in the tenth space R10. Consequently, the contents of operational restriction of the actuators with respect to the traveling lower body 1 executed in the case where an object is detected in the first space R1 basically depend on the orientation of the traveling lower body 1 at that time. Similarly, the contents of operational restriction of the actuators with respect to the revolving upper body 3 executed in the case where an object is detected in the ninth space R9 basically depend on the orientation of the revolving upper body 3 at that time. In other words, the combination of the contents of operational restriction of the actuators with respect to the revolving upper body 3, and the contents of operational restriction of the actuators with respect to the traveling lower body 1 basically varies depending on the position of the shovel 100.

In this way, in the first space R1 to the eighth space R8 and the ninth space R9 to the tenth space R10, operational restriction of an actuator with respect to the revolving upper body 3 and operational restriction of an actuator with respect to the traveling lower body 1 are executed separately for the same object detected simultaneously in the multiple detection spaces.

The eleventh space R11 to the fifteenth space R15 are detection spaces with respect to the excavation attachment. In the present embodiment, the eleventh space R11 to the fifteenth space R15 have a predetermined width (e.g., a width of the interval D4 on the right side plus the other interval D4 on the left side of the axis AX). Here, the width of the detection spaces with respect to the excavation attachment is narrower than the width of the detection spaces with respect to the revolving upper body 3 (the second space R2, the third space R3, the sixth space R6, and the seventh space R7) and narrower than the width of the revolving upper body 3.

The eleventh space R11 is set to have a range on the upper side (+Z-side) with respect to the excavation attachment, from the axis TX to the left end of an interval D8 on the front side (+X side) of the axis TX; and a range from a virtual horizontal plane where the shovel 100 is positioned, to the upper end of an interval D9 on the upper side (+Z side) of the virtual horizontal plane. Also, the eleventh space R11 is set to have a range higher than the tip P5 of the arm 5 on the front side of the excavation attachment. The interval D8 is a value based on, for example, the maximum radius of revolution of the excavation attachment. The interval D8 may be given by a function having as an argument the current radius of revolution of the excavation attachment. The interval D9 is a value based on, for example, the highest reachable point of the excavation attachment. An object present in the eleventh space R11 has a risk of coming into contact with the excavation attachment, for example, when the excavation attachment is raised.

The twelfth space R12 is set to have a range on the upper side (+Z-side) with respect to the virtual horizontal plane and on the lower side (−Z-side) with respect to the excavation attachment; and a range on the front side (+X side) of the axis TX, from the axis TX to the left end of the interval D8. Also, the twelfth space R12 is set to have a range lower than the tip P5 of the arm 5 on the front side of the excavation attachment. An object present in the twelfth space R12 has a risk of coming into contact with the excavation attachment, for example, when the excavation attachment descends.

The thirteenth space R13 is set to have a range on the front side (+X side) of the axis TX, from the left end of the interval D8 to the left end of an interval D10; and a range from the virtual horizontal plane to the upper end of the interval D9 on the upper side (+Z side) of the virtual horizontal plane. The interval D10 is a value based on, for example, the maximum radius of revolution of the excavation attachment. The interval D10 may be given by a function having as an argument the current radius of revolution of the excavation attachment. An object present in the thirteenth space R13 has a risk of coming into contact with the excavation attachment, for example, when the excavation attachment extends.

The fourteenth space R14 is set to have a range on the lower side (−Z side) of the virtual horizontal plane, from the virtual horizontal plane to the lower end of an interval D11; and a range on the front side (+X side) of the axis TX, from the axis TX to the left end of the interval D8. The interval D11 is a value based on, for example, the deepest reachable point of the excavation attachment. An object present in the fourteenth space R14 has a risk of coming into contact with the excavation attachment, for example, when the excavation attachment contracts during deep digging with the excavation attachment.

The fifteenth space R15 is set to have a range on the lower side (−Z side) of the virtual horizontal plane, from the virtual horizontal plane to the lower end of the interval D11; and a range on the front side (+X side) of the axis TX, from the left end of the interval D8 to the left end of the interval D10. An object present in the fifteenth space R15 has a risk of coming into contact with the excavation attachment, for example, when the excavation attachment extends during deep digging with the excavation attachment.

In order to prevent contact between an excavation attachment and an object, operational restriction is executed in the direction of rotation of the attachment in the eleventh space R11 to the fifteenth space R15.

Each of the ninth and the tenth space R10 as the detection spaces with respect to the traveling lower body 1 may at least partially overlap one of the eleventh space R11 to the fifteenth space R15 as the detection spaces with respect to the excavation attachment. For example, each of the eleventh space R11 and the twelfth space R12 may overlap the ninth space R9, or may overlap the tenth space R10. Therefore, an object detected in the twelfth space R12 may be detected in the ninth space R9, or may be detected in the tenth space R10. Consequently, the contents of operational restriction of the actuators with respect to the traveling lower body 1 executed in the case where an object is detected in the twelfth space R12 basically depend on the orientation of the traveling lower body 1 at that time. In other words, the combination of the contents of operational restriction of the actuators with respect to the excavation attachment, and the contents of operational restriction of the actuators with respect to the traveling lower body 1 basically varies depending on the position of the shovel 100.

In this way, in the case where the same single object is detected simultaneously in multiple detection spaces, operational restriction is executed separately for the respective actuators.

In the embodiment described above, although an example has been described in which the first space R1 to the fifteenth space R15 are set, a sixteenth space R16 and a seventeenth space R17 may be further set as the detection spaces with respect to the hydraulic motors for traveling 2M in neighboring regions on the right and left of the traveling lower body 1. The neighboring regions are regions, for example, within the turning radius of the crawlers 1C. In other words, the neighboring regions are, for example, regions where the crawlers 1C are reachable when a spin turn is performed using the crawlers 1C. This enables, even in the case where the operator tilts the right and left traveling levers 26D in the directions reverse to each other when there is an object in the sixteenth space R16 and the seventeenth space R17 set in the neighborhood region in the right and left of the traveling lower body 1, the controller 30 to prevent the right and left hydraulic motors for traveling 2M from revolving in the directions reverse to each other, and thereby, to prevent the crawlers 1C from making a spin turn. Also, the detection spaces such as the first space R1 to the eighth space R8 and the like in FIG. 5A may not necessarily be set to be partitioned along a line parallel to the front-and-back axis or the right-and-left axis of the revolving upper body 3. The detection spaces may be set, for example, to be partitioned by lines extending radially from the center of revolution. Also, the boundaries of the detection spaces may be set to be variable depending on a change in the radius of revolution. Also, the eleventh space R11 to the fifteenth space R15 in FIG. 5C are set to be variable depending on the position of the excavation attachment. However, the eleventh space R11 to the fifteenth space R15 may not necessarily be set to be partitioned along a line parallel to the pivot or the front-and-back axis of the revolving upper body 3. The detection spaces may be set, for example, based on the radius of rotation of each of the driven objects, such as the boom 4 and the arm 5.

As described above, in the present embodiment, multiple detection spaces are set in the surroundings of the shovel 100, based on the movable ranges of the excavation attachment and the revolving upper body 3. Further, the controller 30 may be configured to identify the type of a detected object, by analyzing image data or the like input from the object detection device 70. In this case, the controller 30 may determine at least the motion of at least one of the revolving upper body 3 and the excavation attachment, based on which detection space the object is detected, the type of the detected object, the positional relationship between the object and the shovel 100, and the like.

Next, with reference to FIG. 6, an example of the configuration of the reference table 50 will be described. FIG. 6 is a diagram illustrating an example of the configuration of the reference table 50.

In a state where an object is detected in one or more detection spaces among the first space R1 to the fifteenth space R15, when performing an operation restriction process, the controller 30 refers to the reference table 50 to determine whether the driven object approaches the object if the driven object is moved.

An "X" in FIG. 6 denotes that the motion of the driven object is to be restricted because the driven object would approach the object. A "O" in FIG. 6 denotes that the motion of the driven object is not to be restricted because the driven object would not approach the object. FIG. 6 shows, for example, that a right revolution of the revolving upper body 3 is restricted by the controller 30, for example, in a state where an object is detected in the first space R1 in FIG. 5A, and in the case where the left operation lever 26L is tilted down in the right direction to perform a right revolution operation. Specifically, the controller 30 outputs a cut-off command to the control valve 60 illustrated in FIG. 3 to switch the pilot line CD1 to a cut-off state to cause the left operation lever 26L to transition to a disabled state, so as to prevent the revolving upper body 3 from executing a right revolution.

FIG. 6 also shows that forward movement of the crawlers 1C is restricted by the controller 30, for example, in a state where an object is detected in the ninth space R9 in FIG. 5B, and in the case where the traveling lever 26D is tilted down in the forward (far) direction to perform a forward move operation. Specifically, the controller 30 outputs a cut-off command to the control valve 60 illustrated in FIG. 3 to switch the pilot line CD1 to a cut-off state, to cause the traveling lever 26D to transition to a disabled state, so as to prevent the crawlers 1C from moving forward.

FIG. 6 also shows that descending of the boom 4 is restricted by the controller 30, for example, in a state where an object is detected in the twelfth space R12 in FIG. 5C, and in the case where the right operation lever 26R is tilted down in the forward (far) direction to perform a boom-down operation. Specifically, the controller 30 outputs a cut-off command to the control valve 60 illustrated in FIG. 3, to switch the pilot line CD1 to a cut-off state, and to cause the right operation lever 26R to transition to a disabled state, so as to prevent the boom 4 from descending.

Here, even in the case where an object is detected in the same location (in the same detection space), as long as the detection timing is different, the controller 30 determines whether to perform operational restriction depending on the direction in which an actuator drives; therefore, the controller 30 may perform the operational restriction, or may not perform the operational restriction. Note that the direction in which an actuator drives means, for example, the direction of extension and contraction of a hydraulic cylinder, the direction of revolution of a hydraulic motor, or the like.

Also, the controller 30 separately determines whether an object is detected in a detection space with respect to the revolving upper body 3, and whether an object is detected in a detection space with respect to the traveling lower body 1. Therefore, even in the case where an object is detected in the same location (in the same detection space), as long as the detection timing is different, the controller 30 may execute or may not execute the operational restriction of an actuator with respect to the revolving upper body 3, and may execute or may not execute the operational restriction of an actuator with respect to the traveling lower body 1.

Further, even in the case where an object is detected in the same location (in the same detection space), as long as the detection timing is different, the controller 30 determines whether to perform operational restriction depending on the rotational direction of the attachment; therefore, the controller 30 may perform the operational restriction, or may not perform the operational restriction.

As described above, in the present embodiment, in association with each of the multiple detection spaces, for each actuator, a direction is determined in which the operational restriction is applied to the actuator. Specifically, based on the reference table 50, the controller 30 determines whether the operational direction of the driven object is coincident with a direction heading for the object; and if it is determined that the operational direction of the driven object is coincident with a direction heading for the object (YES of Step ST3 in FIG. 4), the motion of the driven object can be restricted (Step ST4 in FIG. 4). At this time, based on the reference table 50, the controller 30 restricts the motion of the driven object by restricting the motion of the actuator driving the driven object determined as heading for the object. Also, based on the reference table 50, the controller 30 determines whether the operational direction of the driven object is coincident with a direction heading for the object; and if it is determined that the operational direction of the driven object is not a direction heading for the object (NO of Step ST3 in FIG. 4), the driven object can be operated without restricting the motion of the driven object. At this time, based on the reference table 50, the controller 30 can activate the driven object by allowing the actuator to move, which drives the driven object determined as not heading for the object. In this way, the operational restriction of an actuator is selectively executed depending on in which of the detection spaces an object is detected.

Figure 7:
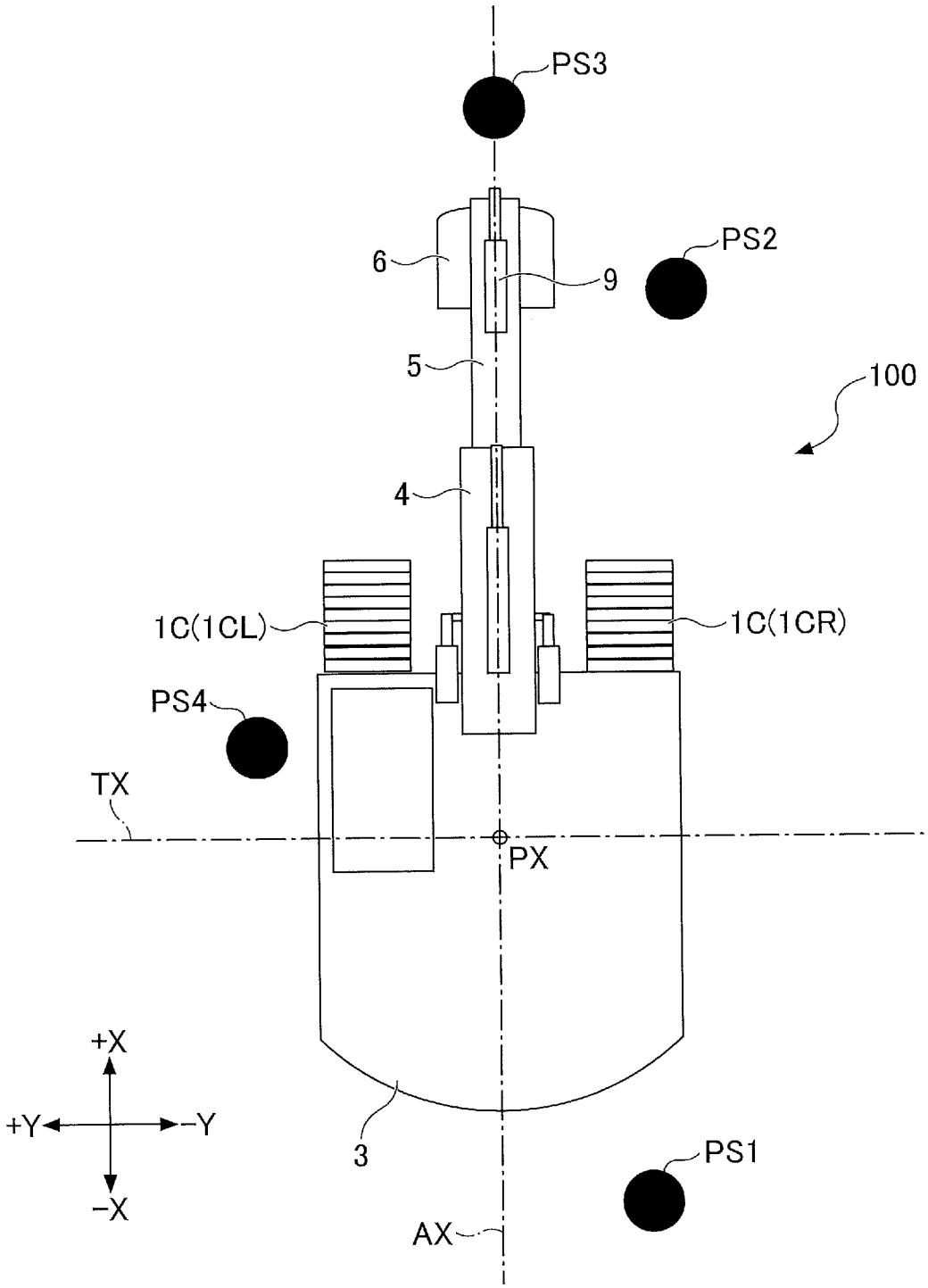
FIG. 7 is a top view of a shovel in a working site.

Next, with reference to FIG. 7, an actual motion of the shovel 100 that can perform the operation restriction process, will be described. FIG. 7 is a top view of the shovel 100 in a working site.

In the example in FIG. 7, when the controller 30 determines that the operation device 26 is operated based on the output of the operational pressure sensor 29, the controller 30 determines whether an object is detected in each of the 15 detection spaces illustrated in FIG. 5. Then, in the case where an object is detected in any of the 15 detection spaces, the controller 30 refers to the reference table 50 illustrated in FIG. 6 to determine whether the motion of a driven object to be executed right away is an allowable motion. The motion of the driven object is determined as an allowable motion, for example, if there is no risk that the shovel 100 comes into contact with the object.

Specifically, in the case where an object PS1 illustrated in FIG. 7 is detected, the controller 30 determines that the object is present in the tenth space R10 illustrated in FIG. 5B.

Therefore, the controller 30 determines that only backward movement of the crawlers 1C by a backward move operation using the traveling lever 26D is not an allowable motion. This is because if the crawlers 1C are moved backward in the state in FIG. 7, the operational direction of the crawlers 1C is coincident with a direction heading for the object PS1. On the other hand, the controller 30 determines that any other motions are allowable. In other words, the controller 30 determines that right revolution, left revolution, forward movement, boom-up, boom-down, arm opening, arm closing, bucket opening, and bucket closing are allowable motions. This is because even if causing the revolving upper body 3 to make a right revolution in the state in FIG. 7, the operational direction of the revolving upper body 3 is not coincident with a direction heading for the object PS1. The same applies to the other motions.

In the case where an object PS2 illustrated in FIG. 7 is detected, the controller 30 determines that the object is present in each of the second space R2 illustrated in FIG. 5A and the ninth space R9 illustrated in FIG. 5B.

Therefore, the controller 30 determines that revolution of the revolving upper body 3 by a revolution operation using the left operation lever 26L, and forward movement of the crawlers 1C by a forward move operation using the traveling lever 26D are not allowable motions. This is because if causing the revolving upper body 3 to make a right revolution in the state in FIG. 7, the operational direction of the revolving upper body 3 is coincident with a direction heading for the object PS2. This is also because if causing the crawlers 1C to move forward in the state in FIG. 7, the operational direction of the crawlers 1C is coincident with a direction heading for the object PS2. On the other hand, the controller 30 determines that any other motions are allowable. In other words, the controller 30 determines that backward movement, boom-up, boom-down, arm opening, arm closing, bucket opening, and bucket closing are allowable motions. This is because even if causing the boom 4 to rise in the state in FIG. 7, the operational direction of the boom 4 is not coincident with a direction heading for the object PS2. The same applies to the other motions.

In the case where an object PS3 illustrated in FIG. 7 is detected, the controller 30 determines that the object is present in the thirteenth space R13 illustrated in FIG. 5C.

Therefore, the controller 30 determines that opening of the arm 5 by an arm-opening operation using the right operation lever 26R is not an allowable motion. This is because if causing the arm 5 to open in the state in FIG. 7, the operational direction of the arm 5 is coincident with a direction heading for the object PS3. The same applies to a bucket-opening operation. On the other hand, the controller 30 determines that any other motions are allowable. In other words, the controller 30 determines that right revolution, left revolution, forward movement, backward movement, boom-up, boom-down, arm closing, and bucket closing are allowable motions. This is because even if causing the revolving upper body 3 to make a right revolution in the state in FIG. 7, the operational direction of the revolving upper body 3 is not coincident with a direction heading for the object PS3. The same applies to the other motions.

In the case where an object PS4 illustrated in FIG. 7 is detected, the controller 30 determines that the object is present in the third space R3 illustrated in FIG. 5A.

Therefore, the controller 30 determines that revolution of the revolving upper body 3 by a revolution operation using the left operation lever 26L is not an allowable motion. This is because if causing the revolving upper body 3 to make a left revolution in the state in FIG. 7, the operational direction of the revolving upper body 3 is coincident with a direction heading for the object PS4. This is also because if causing the revolving upper body 3 to make a right revolution in the state in FIG. 7, the operational direction of the revolving upper body 3 (counterweight) is coincident with a direction heading for the object PS4. On the other hand, the controller 30 determines that any other motions are allowable. In other words, the controller 30 determines that forward movement, backward movement, boom-up, boom-down, arm opening, arm closing, bucket opening, and bucket closing are allowable motions. This is because even if causing the arm 5 to open in the state in FIG. 7, the operational direction of the arm 5 is not coincident with a direction heading for the object PS4. The same applies to the other motions.

As described above, in the case where an operation is performed through the operation device 26 while detecting an object in one of the 15 detection spaces, the controller 30 determines whether it is allowable to move the driven object in response to the operation. Also, the controller 30 allows the motion of the driven object in the case where it is determined that it is allowable to move. On the other hand, the controller 30 restricts the motion of the driven object in the case where it is determined that it is not allowable to move. Specifically, the controller 30 outputs a cut-off command to the control valve 60 illustrated in FIG. 3 to switch the pilot line CD1 to a cut-off state. As a result, the operation through the operation device 26 is disabled.

Figure 8:
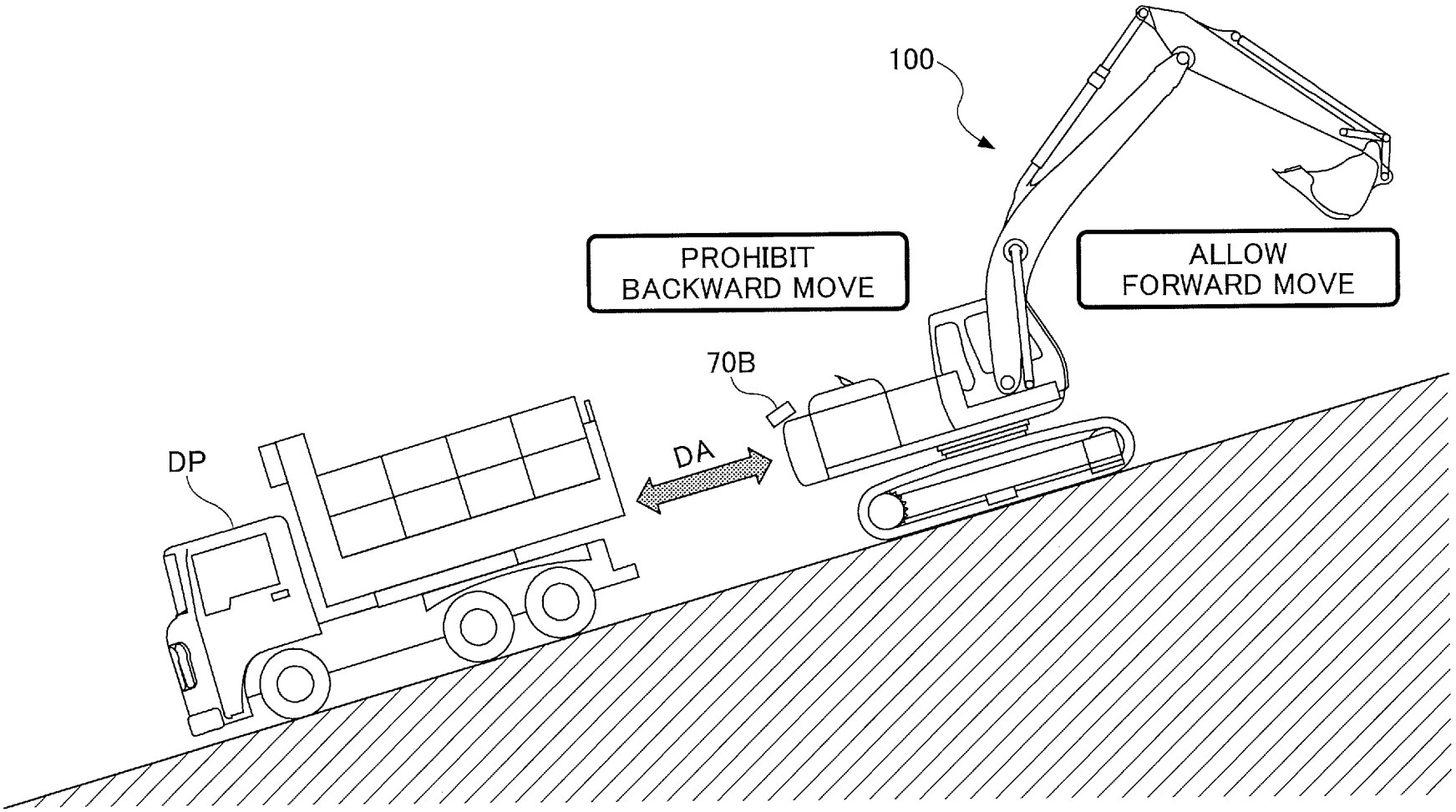
FIG. 8 is a side view of a shovel working on a slope.

Next, with reference to FIG. 8, an example of the effects of the operation restriction process will be described. FIG. 8 is a side view of the shovel 100 working on a slope.

In the example in FIG. 8, the shovel 100 approaches a dump truck DP while moving backward to perform work of loading earth and sand onto the bed of the dump truck DP that is stopped on the slope. Based on the output of the backward sensor 70B, the controller 30 continuously monitors the interval DA between the shovel 100 (counterweight) and the dump truck DP. The operator of the shovel 100 attempts to stop the backward movement of the shovel 100 by returning the traveling lever 26D to the neutral position when the interval DA reaches a desired interval. At this time, the shovel 100 may continue to move backward due to inertia even though the traveling lever 26D has been returned to the neutral position.

If the dump truck DP enters the tenth space R10 (see FIG. 5B), namely, if the interval DA becomes shorter than a predetermined value, the controller 30 outputs a cut-off command to the control valve 60 to switch the pilot line CD1 to a cut-off state. This is to put the traveling lever 26D in a disabled state to stop revolving of the hydraulic motors for traveling 2M. In this way, the controller 30 attempts to stop the backward movement of the shovel 100 even if the traveling lever 26D has not been returned to the neutral position. However, there may be a case where the controller 30 cannot immediately stop the shovel 100 that continues to move backward due to inertia.

At this time, the operator of the shovel 100 attempts to stop the backward movement due to inertia by, for example, tilting the traveling lever 26D in the FW (far) direction to cause the shovel 100 to move forward. However, in a configuration in which the motion of the shovel is uniformly restricted in the case where an object is present in the surroundings of the shovel 100, not only a backward move operation but also a forward move operation are disabled. Therefore, the operator of the shovel 100 may not be able to move the shovel 100 forward even though he or she knows that it is effective to move the shovel 100 forward to stop the backward movement due to inertia.

In the configuration according to the embodiment in the present disclosure, the controller 30 determines whether it is allowable to move a driven object for each operation performed through the operation device 26. Therefore, the controller 30 can revolve the hydraulic motors for traveling 2M in the forward direction in response to a forward move operation performed by the operator, even in a situation as illustrated in FIG. 8. This is because even if moving the shovel 100 forward, it is possible to determine that there is no risk that the shovel 100 would approach the object too closely. As a result, the controller 30 can quickly stop the backward movement due to inertia and prevent the shovel 100 from approaching the dump truck DP too closely.

Figure 9:
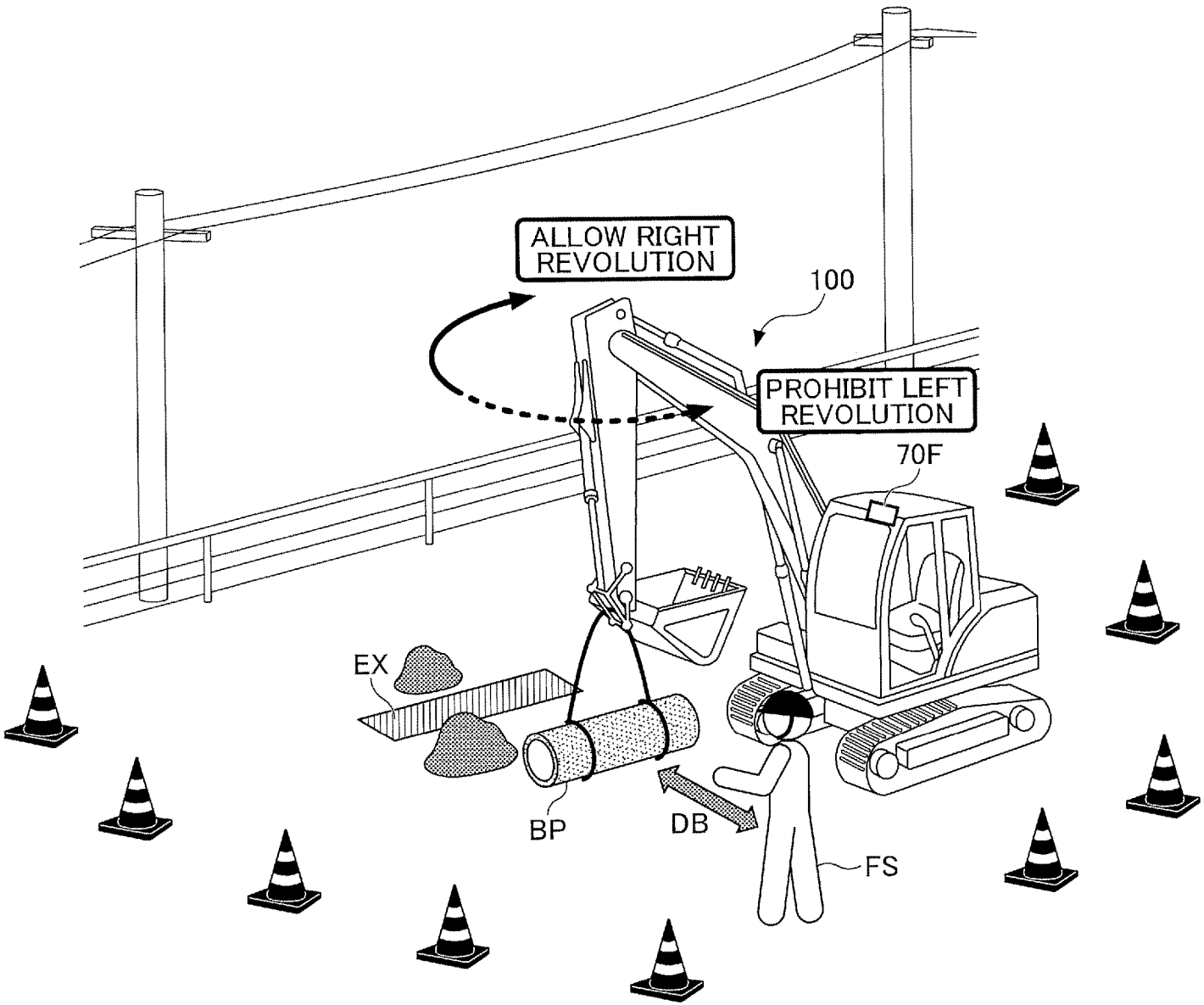
FIG. 9 is a perspective view of a shovel performing a crane work.

Next, with reference to FIG. 9, another example of the effects of the operation restriction process will be described. FIG. 9 is a perspective view of the shovel 100 performing a crane work.

In the example in FIG. 9, the shovel 100 hoists a sewer pipe BP to bury the sewer pipe BP in an excavated ditch EX formed in a road. The operator of the shovel 100 is going to perform a right revolution operation according to instructions of a slinging worker FS present in the front left direction of the shovel 100. Based on the output of the forward sensor 70F, the controller 30 continuously monitors the interval DB between the shovel 100 (bucket 6) or the sewer pipe BP and the slinging worker FS. The operator of the shovel 100 is using the left operation lever 26L to cause the revolving upper body 3 to make a right revolution, so as to bring the sewer pipe BP closer to the excavated ditch EX. At this time, there may be a case where the slinging worker FS approaches the shovel 100 (bucket 6) or the sewer pipe BP too closely, for example, to adjust the position of the sewer pipe BP.

in a state where the interval DB becomes shorter than the predetermined value, namely, in a state where the slinging worker FS is present in the fourth space R4 (see FIG. 5A), once a left revolution operation is performed, the controller 30 outputs a cut-off command to the control valve 60 to switch the pilot line CD1 to a cut-off state. This is to put the left operation lever 26L in a disabled state to stop revolving of the hydraulic motor for revolution 2A.

However, in a configuration in which the motion of the shovel is uniformly restricted in the case where an object is present in the surroundings of the shovel 100, not only a left revolution operation but also a right revolution operation are disabled.

In the configuration according to the embodiment in the present disclosure, the controller 30 determines whether it is allowable to move a driven object for each operation performed through the operation device 26. Therefore, in a situation as illustrated in FIG. 9, the controller 30 can allow the hydraulic motor for revolution 2A to revolve in response to a right revolution operation performed by the operator, while inhibiting revolutions of the hydraulic motor for revolution 2A in response to a left revolution operation performed by the operator. This is because even if causing the shovel 100 to make a right revolution, it is possible to determine that there is no risk that the shovel 100 would approach the object too closely. As a result, the controller 30 can quickly bring the sewer pipe BP closer to the excavated ditch EX while preventing the shovel 100 (bucket 6) or the sewer pipe BP from approaching the slinging worker FS too closely.

Figure 10:
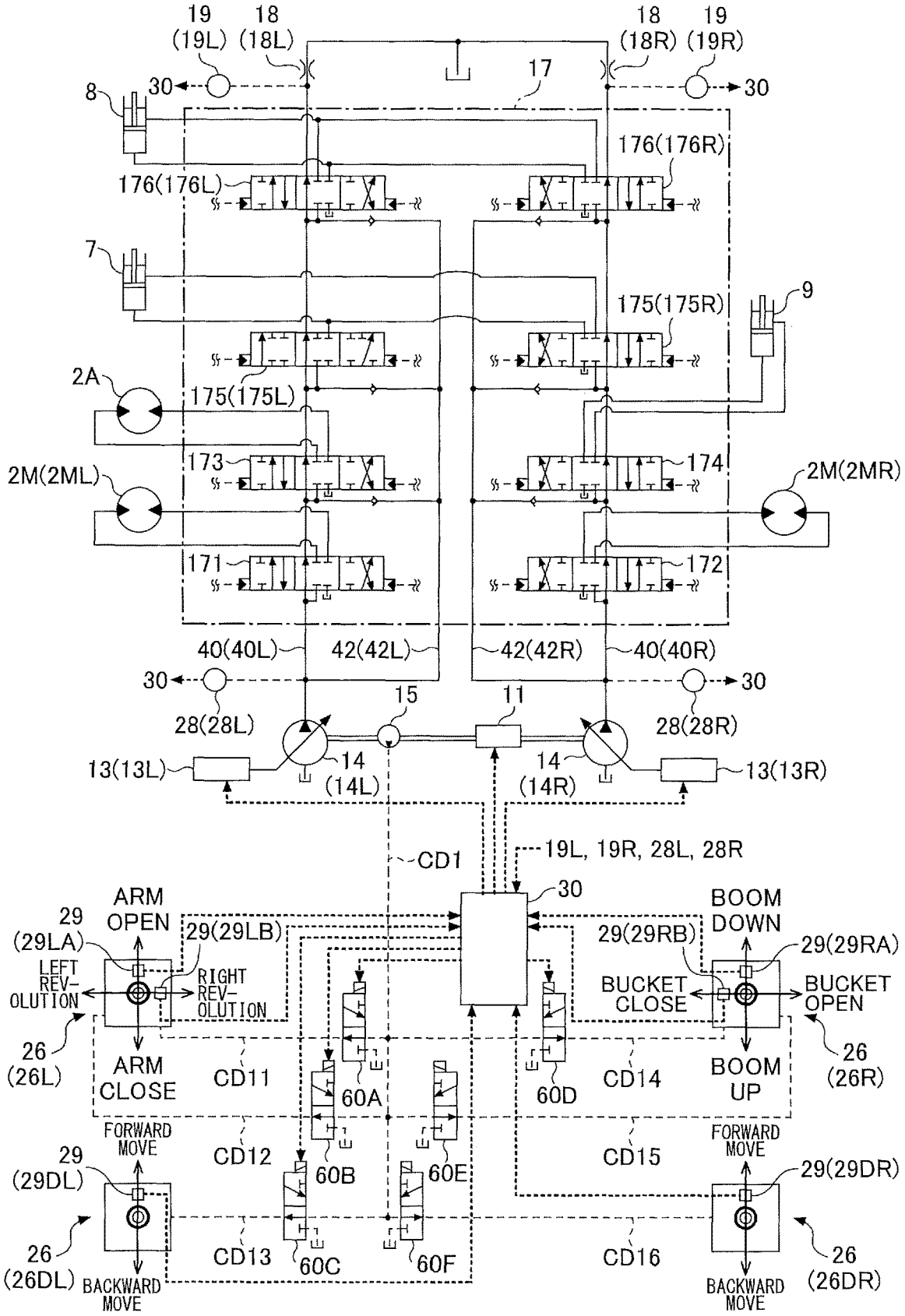
FIG. 10 is a schematic view illustrating another example of a configuration of a hydraulic system installed in a shovel.

Next, with reference to FIG. 10, another example of a configuration of a hydraulic system installed in the shovel 100 will be described. FIG. 10 is a schematic view illustrating another example of a configuration of a hydraulic system installed the shovel 100. The hydraulic system in FIG. 10 can make switching between an enabled state and a disabled state separately for each of the multiple operation devices 26, and in this respect, differs from the hydraulic system in FIG. 3, although the other respects are common. Therefore, the description of the common parts is omitted and the difference parts will be described in detail.

The hydraulic system in FIG. 10 includes control valves 60A to 60F. The control valve 60A is configured to switch a part related to an arm operation in the left operation lever 26L between an enabled state and a disabled state. In the present embodiment, the control valve 60A is a solenoid valve capable of switching a pilot line CD11 between a communicating state and a cut-off state, which connects the pilot pump 15 and the part related to an arm operation in the left operation lever 26L. Specifically, the control valve 60A is configured to switch the pilot line CD11 between a communicating state and a cut-off state in response to a command from the controller 30.

The control valve 60B is a solenoid valve capable of switching a pilot line CD12 between a communicating state and a cut-off state, which connects the pilot pump 15 and the part related to a revolution operation in the left operation lever 26L. Specifically, the control valve 60B is configured to switch the pilot line CD12 between a communicating state and a cut-off state in response to a command from the controller 30.

The control valve 60C is a solenoid valve capable of switching a pilot line CD13 between a communicating state and a cut-off state, which connects the pilot pump 15 to the left traveling lever 26DL. Specifically, the control valve 60C is configured to switch the pilot line CD13 between a communicating state and a cut-off state in response to a command from the controller 30.

The control valve 60D is a solenoid valve capable of switching a pilot line CD14 between a communicating state and a cut-off state, which connects the pilot pump 15 and the part related to a boom operation in the right operation lever 26R. Specifically, the control valve 60D is configured to switch the pilot line CD14 between a communicating state and a cut-off state in response to a command from the controller 30.

The control valve 60E is a solenoid valve capable of switching a pilot line CD15 between a communicating state and a cut-off state, which connects the pilot pump 15 and the part related to a bucket operation in the right operation lever 26R. Specifically, the control valve 60E is configured to switch the pilot line CD15 between a communicating state and a cut-off state in response to a command from the controller 30.

The control valve 60F is a solenoid valve capable of switching a pilot line CD16 between a communicating state and a cut-off state, which connects the pilot pump 15 to the right traveling lever 26DR. Specifically, the control valve 60F is configured to switch the pilot line CD16 between a communicating state and a cut-off state in response to a command from the controller 30.

The control valves 60A to 60F may be configured to be operable together with a gate lock lever. Specifically, the control valve 60A may be configured to cause the pilot line CD11 to transition to a cut-off state when the gate lock lever is pressed down, and to cause the pilot line CD11 to transition to a communicating state when the gate lock lever is pulled up. The same applies to the control valves 60B to 60F.

With this configuration, the controller 30 can independently make switching between an enabled state and a disabled state for each of the part related to an arm operation and the part related to a revolution operation in the left operation lever 26L, the part related to a boom operation and the part related to a bucket operation in the right operation lever 26R, the left traveling lever 26DL, and the right traveling lever 26DR.

Therefore, the controller 30 can cause the shovel 100 to operate properly even in the case where composite operations are performed. For example, the controller 30 may allow the motion of one driven object according to one operation among the composite operations while inhibiting the motion of another driven object according to another operation among the composite operations. Alternatively, in the case of inhibiting the motion of one driven object according to one operation among the composite operations, the controller 30 may be configured to inhibit motions of the other driven objects according to the other operations among the composite operation, regardless of the settings in the reference table 50.

Figure 11:
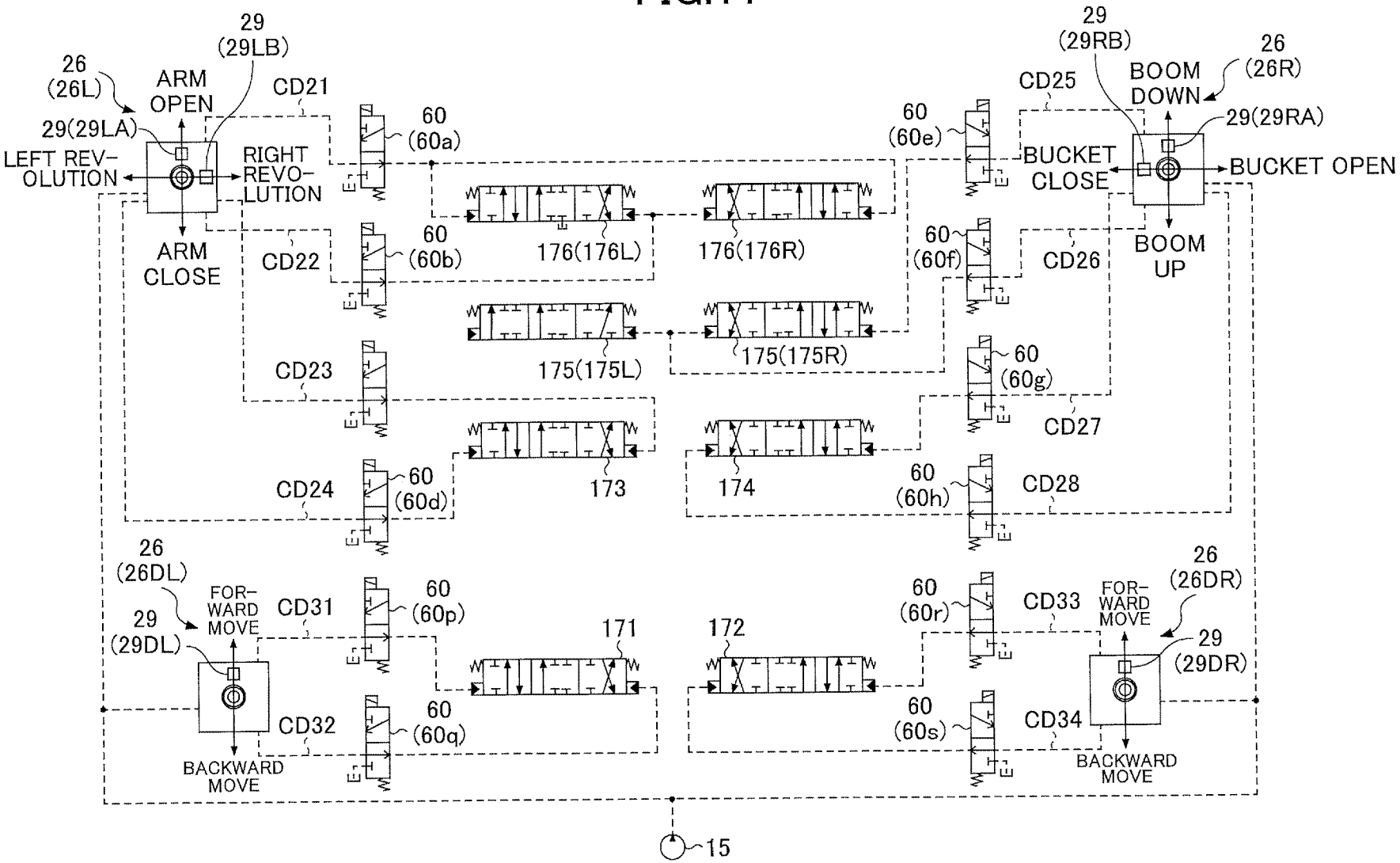
FIG. 11 is a schematic view illustrating yet another example of a configuration of a hydraulic system installed in a shovel.
Figure 12:
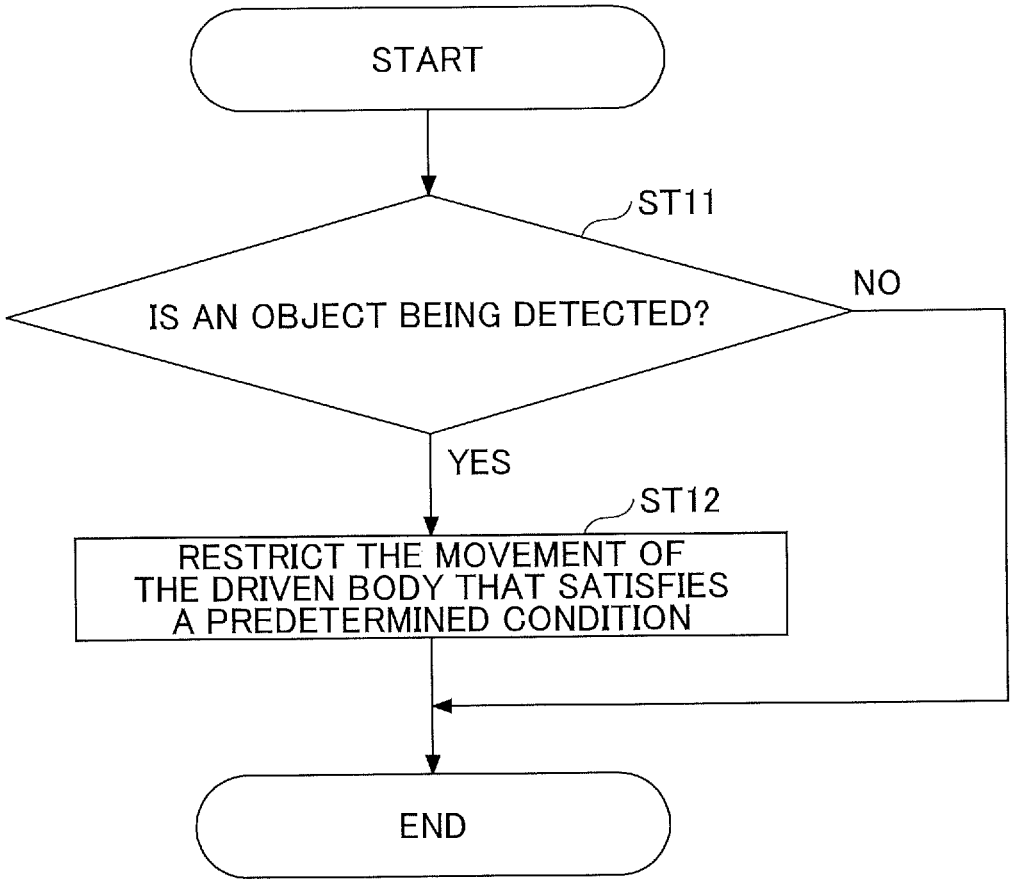
FIG. 12 is a flow chart illustrating another example of an operation restriction process.

Next, with reference to FIG. 11, yet another example of a configuration of a hydraulic system installed in the shovel 100 will be described. FIG. 11 is a schematic view illustrating yet another example of a configuration of a hydraulic system installed in the shovel 100. The hydraulic system in FIG. 11 is configured to be capable of switching between a communicating state and a cut-off state of the pilot line between the operation device 26 and the respective pilot ports of the control valves 171 to 176 by the control valves 60, and in this respect, differs from the hydraulic systems in FIG. 3 and FIG. 10, although the other respects are common. Therefore, the description of the common parts is omitted and the difference parts will be described in detail. Note that in FIG. 11, for the sake of clarification, illustration is omitted for components other than the pilot pump 15, the operation device 26, the control valve 60, and the control valves 171 to 176; however, the hydraulic system in FIG. 11 has the same configuration as the hydraulic system in FIG. 3. The hydraulic system in FIG. 11 includes control valves 60*a* to 60*h* and 60*p* to 60*s* as the control valves 60. The control valve 60*a* is configured to switch a part related to an arm-opening operation in the left operation lever 26L between an enabled state and a disabled state. In the present embodiment, the control valve 60*a* is a solenoid valve capable of switching a pilot line CD21 between a communicating state and a cut-off state, which connects the part related to an arm-opening operation in the left operation lever 26L, and the left pilot port of the control valve 176L and the right pilot port of the control valve 176R. Specifically, the control valve 60*a* is configured to switch the pilot line CD21 between a communicating state and a cut-off state in response to a command from the controller 30. The control valve 60*b* is a solenoid valve capable of switching a pilot line CD22 between a communicating state and a cut-off state, which connects the part related to an arm-closing operation on the left operation lever 26L with the right pilot port of the control valve 176L and the left pilot port of the control valve 176R. Specifically, the control valve 60*b* is configured to switch the pilot line CD22 between a communicating state and a cut-off state in response to a command from the controller 30. The control valve 60*c* is a solenoid valve capable of switching a pilot line CD23 between a communicating state and a cut-off state, which connects the part related to a right revolution operation in the left operation lever 26L and the right pilot port of the control valve 173. Specifically, the control valve 60*c* is configured to switch the pilot line CD23 between a communicating state and a cut-off state in response to a command from the controller 30. The control valve 60*d* is a solenoid valve capable of switching a pilot line CD24 between a communicating state and a cut-off state, which connects the part related to a left revolution operation in the left operation lever 26L and the left pilot port of the control valve 173. Specifically, the control valve 60*d* is configured to switch the pilot line CD24 between a communicating state and a cut-off state in response to a command from the controller 30. The control valve 60*e* is a solenoid valve capable of switching a pilot line CD25 between a communicating state and a cut-off state, which connects the part related to a boom-down operation in the right operation lever 26R and the right pilot port of the control valve 175R. Specifically, the control valve 60*e* is configured to switch the pilot line CD25 between a communicating state and a cut-off state in response to a command from the controller 30. The control valve 60*f* is a solenoid valve capable of switching a pilot line CD26 between a communicating state and a cut-off state, which connects the part related to a boom-up operation on the right operation lever 26R with the right pilot port of the control valve 175L and the left pilot port of the control valve 175R. Specifically, the control valve 60*f* is configured to switch the pilot line CD26 between a communicating state and a cut-off state in response to a command from the controller 30. The control valve 60*g* is a solenoid valve capable of switching a pilot line CD27 between a communicating state and a cut-off state, which connects the part related to a bucket-closing operation in the right operation lever 26R and the right pilot port of the control valve 174. Specifically, the control valve 60*g* is configured to switch the pilot line CD27 between a communicating state and a cut-off state in response to a command from the controller 30. The control valve 60*h* is a solenoid valve capable of switching a pilot line CD28 between a communicating state and a cut-off state, which connects the part related to a bucket-opening operation in the right operation lever 26R and the left pilot port of the control valve 174. Specifically, the control valve 60*h* is configured to switch the pilot line CD28 between a communicating state and a cut-off state in response to a command from the controller 30. The control valve 60*p* is a solenoid valve capable of switching a pilot line CD31 between a communicating state and a cut-off state, which connects the part related to a forward move operation in the left traveling lever 26DL and the left pilot port of the control valve 171. Specifically, the control valve 60*p* is configured to switch the pilot line CD31 between a communicating state and a cut-off state in response to a command from the controller 30. The control valve 60*q* is a solenoid valve capable of switching a pilot line CD32 between a communicating state and a cut-off state, which connects the part related to a backward move operation in the left traveling lever 26DL and the right pilot port of the control valve 171. Specifically, the control valve 60*q* is configured to switch the pilot line CD32 between a communicating state and a cut-off state in response to a command from the controller 30. The control valve 60*r* is a solenoid valve capable of switching a pilot line CD33 between a communicating state and a cut-off state, which connects the part related to a forward move operation in the right traveling lever 26DR and the right pilot port of the control valve 172. Specifically, the control valve 60*r* is configured to switch the pilot line CD33 between a communicating state and a cut-off state in response to a command from the controller 30. The control valve 60*s* is a solenoid valve capable of switching a pilot line CD34 between a communicating state and a cut-off state, which connects the part related to a backward move operation in the right traveling lever 26DR and the left pilot port of the control valve 172. Specifically, the control valve 60*s* is configured to switch the pilot line CD34 between a communicating state and a cut-off state in response to a command from the controller 30. With this configuration, the controller 30 can make switching between an enabled state and a disabled state for each of the part related to a boom-up operation, the part related to a boom-down operation, the part related to an arm-closing operation, the part related to an arm-opening operation, the part related to a bucket-closing operation, the part related to a bucket-opening operation, the part related to a left revolution operation, the part related to a right revolution operation, the part related to a forward move operation, and the part related to a backward move operation in the operation device 26. Note that in the hydraulic systems in each of the embodiments described above, after determining that the operation device 26 is operated, the controller 30 determines whether to restrict the motion of a driven object based on the presence or absence of an object in a detection space. However, before the operation device 26 is operated, the controller 30 may determine whether to restrict the motion of a driven object based on the presence or absence of an object in a detection space. FIG. 12 is another example of a flow chart of the operation restriction process in which the controller 30 restricts the motion of a driven object before the operation device 26 is operated. The controller 30 repeatedly performs this operation restriction process at predetermined control cycles while the shovel 100 is in operation. First, at Step ST11, the controller 30 determines whether an object is being detected. In the present embodiment, the controller 30 determines whether an object is being detected in a predetermined detection space based on the output of the object detection device 70. If it is determined that an object is not detected (No at Step ST11), the controller 30 terminates the current operation restriction process. If it is determined that an object is being detected (YES at Step ST11), at Step ST12, the controller 30 restricts the motion of a driven object that satisfies a predetermined condition. The motion of a driven object that satisfies the predetermined condition is, for example, a motion of the driven object where the operational direction of the driven object is coincident with a direction heading for the object. In the present embodiment, the controller 30 refers to the reference table 50 stored in the ROM to derive a motion of the driven object that satisfies the condition that the driven object approaches the object if the driven object is moved. For example, if it is possible to determine that in the case of opening the arm 5, the arm 5 approaches the object, the controller 30 derives the motion to open the arm 5 as a motion of the driven object (arm 5) that satisfies the predetermined condition. Then, the controller 30 restricts all derived motions of the driven object. With this configuration, for example, in the case where the controller 30 derives the motion to open the arm 5 as a motion of the driven object that satisfies the predetermined condition, the controller 30 can output a cut-off command to the control valve 60*a* (see FIG. 11) to switch the pilot line CD21 to a cut-off state before an arm-opening operation is performed. Therefore, the controller 30 may put the part related to an arm-opening operation in the left operation lever 26L in a disabled state before an arm-opening operation is performed, so that thereafter, even if an arm-opening operation is performed, the motion to open the arm 5 cannot be performed. Also, in this configuration, the controller 30 can switch the pilot line CD21 to a cut-off state before an arm-opening operation is performed; therefore, compared to a configuration in which the pilot line CD21 is switched to a cut-off state after the arm-opening operation was performed, it is possible to securely prevent the occurrence of vibration or the like of the machine caused by the sudden stop of the motion of the arm 5. Also, although the controller 30 in each of the embodiments described above is configured to cause the operation device 26 basically in an enabled state to exceptionally transition to a disabled state, it may be configured to cause the operation device 26 basically in a disabled state to exceptionally transition to an enabled state. For example, the controller 30 may be configured not to restrict the motion of a driven object in the case where it is determined that the operational direction of the driven object is coincident with a direction heading for an object, but configured to cancel the restriction on the motion of the driven object in the case where it is determined that the operational direction of the driven object is not coincident with a direction heading for the object.

Figure 13A:
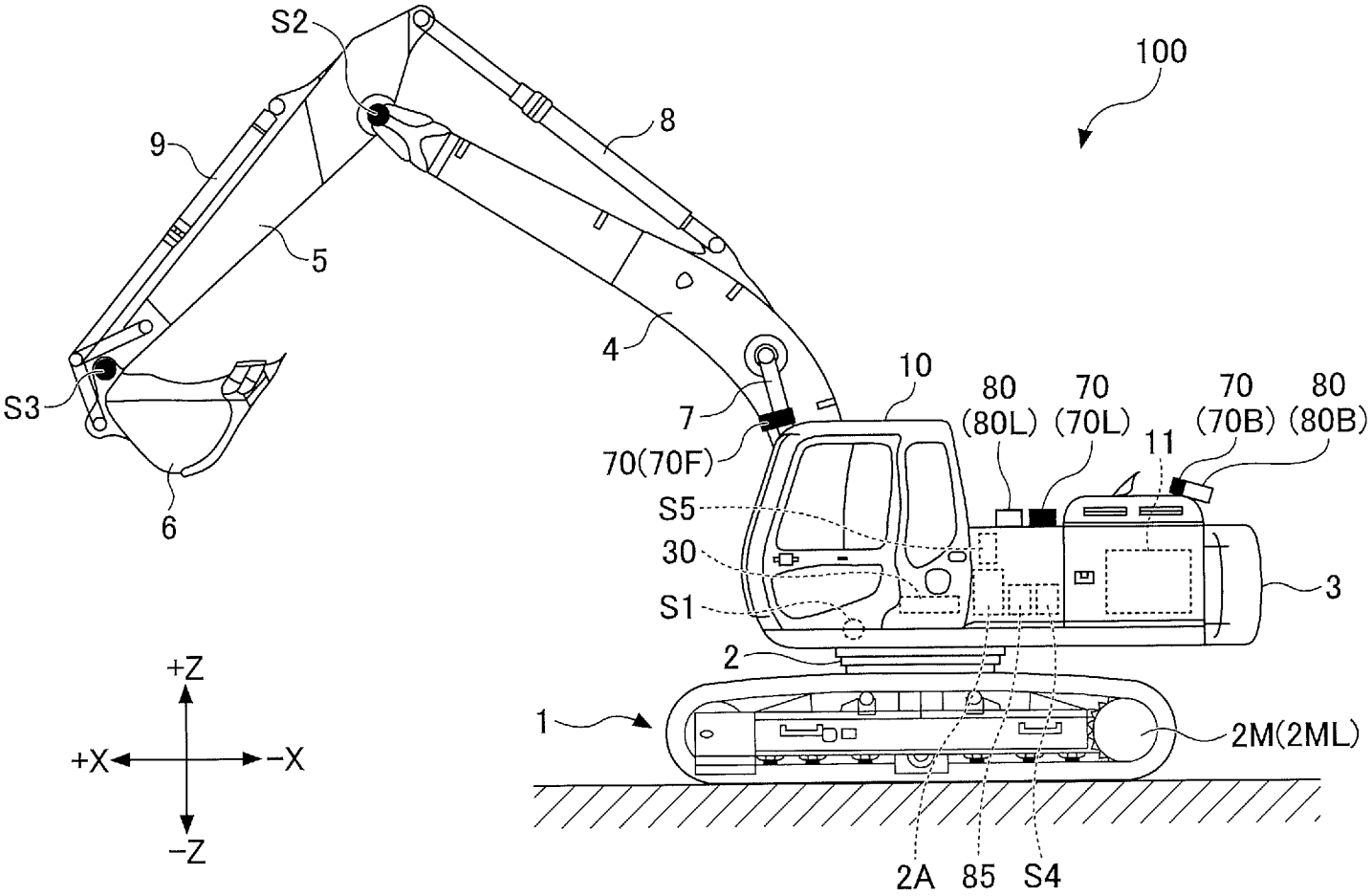
FIG. 13A illustrates another example of a configuration of a shovel according to an embodiment in the present disclosure.
Figure 13B:
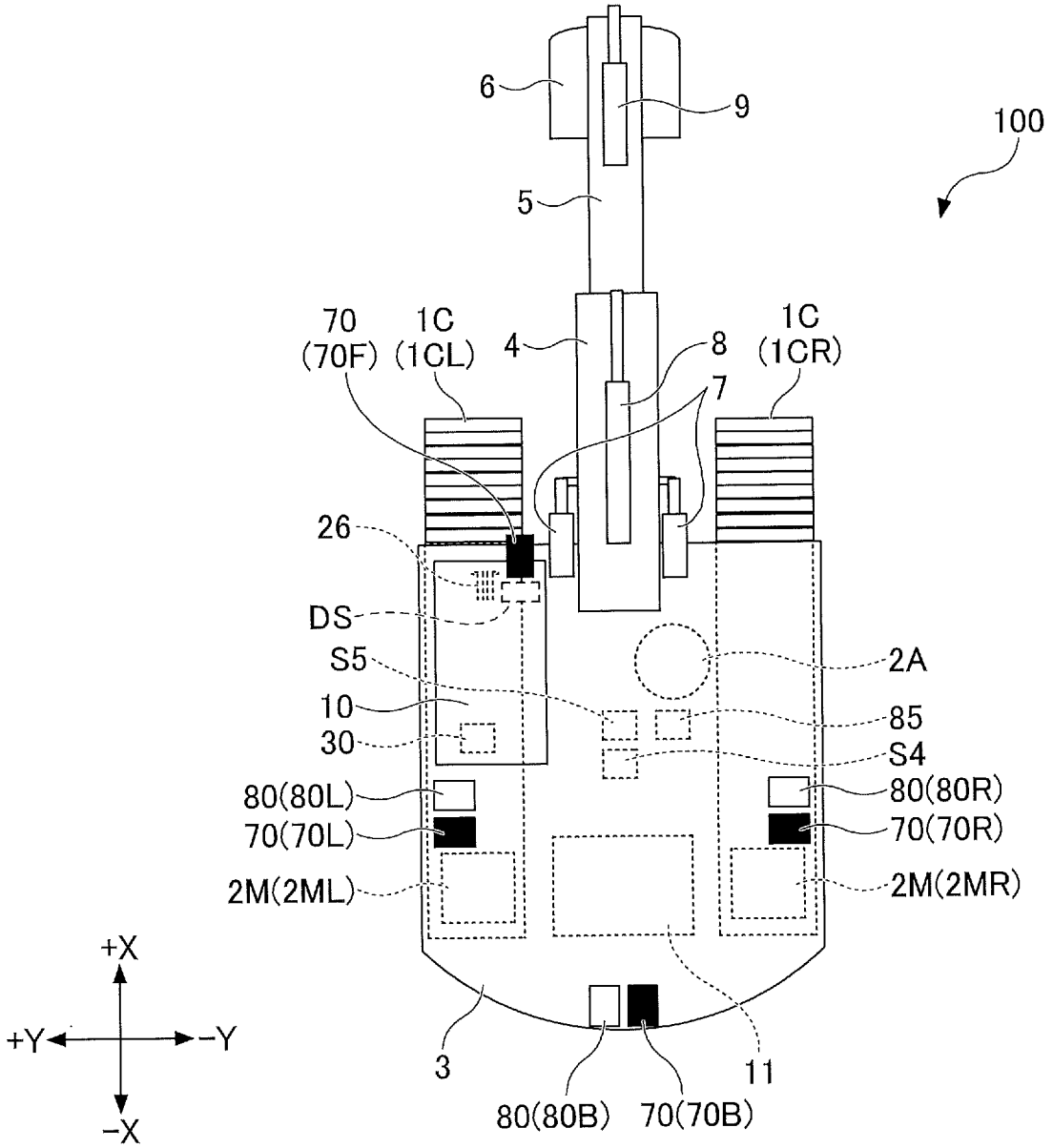
FIG. 13B illustrates another example of a configuration of a shovel according to an embodiment in the present disclosure.

Next, with reference to FIG. 13A and FIG. 13B, another example of a configuration of the shovel 100 will be described. FIGS. 13A and 13B are diagrams illustrating the other example of the configuration of the shovel 100 where FIG. 13A illustrates a side view and FIG. 13B illustrates a top view.

The shovel in FIG. 13A and FIG. 13B has an imaging device 80 installed, and in this respect, differs from the shovel 100 illustrated in FIGS. 1 and 2, although the other respects are common. Therefore, the description of the common parts is omitted and the difference parts will be described in detail.

The imaging device 80 captures an image of the surroundings of the shovel 100. In the example in FIG. 13A and FIG. 13B, the imaging device 80 includes a rear camera 80B attached to the rear end on the upper surface of the revolving upper body 3, a left camera 80L attached to the left end on the upper surface of the revolving upper body 3, and a right camera 80R attached to the right end on the upper surface of the revolving upper body 3. The imaging device 80 may include a front camera.

The rear camera 80B is positioned adjacent to the backward sensor 70B, the left camera 80L is positioned adjacent to the left sensor 70L, and the right camera 80R is positioned adjacent to the right sensor 70R. In the case of including a front camera, the front camera may be positioned adjacent to the forward sensor 70F.

An image captured by the imaging device 80 is displayed on a display device DS installed in the cabin 10. The imaging device 80 may be configured to be capable of displaying a viewpoint-conversed image, such as a birds-eye-view image on the display device DS. A birds-eye-view image is generated, for example, by synthesizing images output by the rear camera 80B, the left camera 80L, and the right camera 80R, respectively.

With this configuration, the shovel 100 in FIG. 13A and FIG. 13B can display an image of an object detected by the object detection device 70 on the display device DS. Therefore, in the case where an operation of a driven object is restricted or inhibited, the operator of the shovel 100 can quickly identify the object that causes the restriction or the inhibition, by viewing the image displayed on the display device DS. As described above, the shovel 100 according to an embodiment in the present disclosure includes the traveling lower body 1, the revolving upper body 3 rotatably installed on a traveling lower body 1, the object detection device 70 provided in the revolving upper body 3, the controller 30 as a control device provided in the revolving upper body 3, and the actuators such as the boom cylinder 7 for moving a driven object such as the boom 4. The object detection device 70 is configured to detect an object in the detection spaces set in the surroundings of the shovel 100. In addition, the controller 30 is configured to allow the motion of a driven object in a direction other than the direction heading for the detected object. With this configuration, the shovel 100 cab prevent the motion of the shovel from being uniformly restricted in the case where an object is present in the surroundings.

In the case where the operational direction of a driven object based on an operation on the operation device 26 is coincident with a direction heading for the detected object, the controller 30 is desirably configured to start braking the driven object or to inhibit the motion of the driven object.

Also, in the case where the operational direction of a driven object based on an operation on the operation device 26 is not coincident with a direction heading for the detected object, the controller 30 is configured to allow the motion of a driven object.

The detection spaces may include, for example, the first space R1 to the eighth space R8 as the detection spaces with respect to the revolving upper body 3 as illustrated in FIG. 5A, and the ninth space R9 and the tenth space R10 as the detection spaces with respect to the traveling lower body 1 as illustrated in FIG. 5B. In this way, the detection spaces with respect to the revolving upper body 3 and the detection spaces with respect to traveling lower body 1 may be set separately.

The detection spaces may include multiple detection spaces, such as the first space R1 to the fifteenth space R15 as illustrated in FIGS. 5A to 5C. Also, the driven objects may include multiple driven objects, such as the traveling lower body 1, the revolution mechanism 2, the revolving upper body 3, the boom 4, the arm 5, and the bucket 6. Also, as illustrated in the reference table 50 in FIG. 6, for each of the detection spaces, whether to allow each driven object to move may be set in advance.

As described above, favorable embodiments according to the present inventive concept have been described in detail. However, the present inventive concept is not restricted to the embodiments described above. Various modifications, substitutions, and the like may be applied to the embodiments described above without deviating from the scope of the present inventive concept. Also, the separately described features can be combined unless a technical inconsistency is introduced.

For example, the embodiments described above disclose a hydraulic operation lever provided with a hydraulic pilot circuit. For example, in the hydraulic pilot circuit related to the left operation lever 26L, hydraulic oil fed from the pilot pump 15 to the left operation lever 26L is transferred to the pilot port of the control valve 176 at a flow rate depending on the opening of a remote control valve that is opened and closed by tilting the left operation lever 26L in the arm opening direction. Also, in the hydraulic pilot circuit related to the right operation lever 26R, hydraulic oil fed from the pilot pump 15 to the right operation lever 26R is transferred to the pilot port of the control valve 175 at a flow rate depending on the opening of a remote control valve that is opened and closed by tilting the right operation lever 26R in the boom-up direction.

Figure 14:
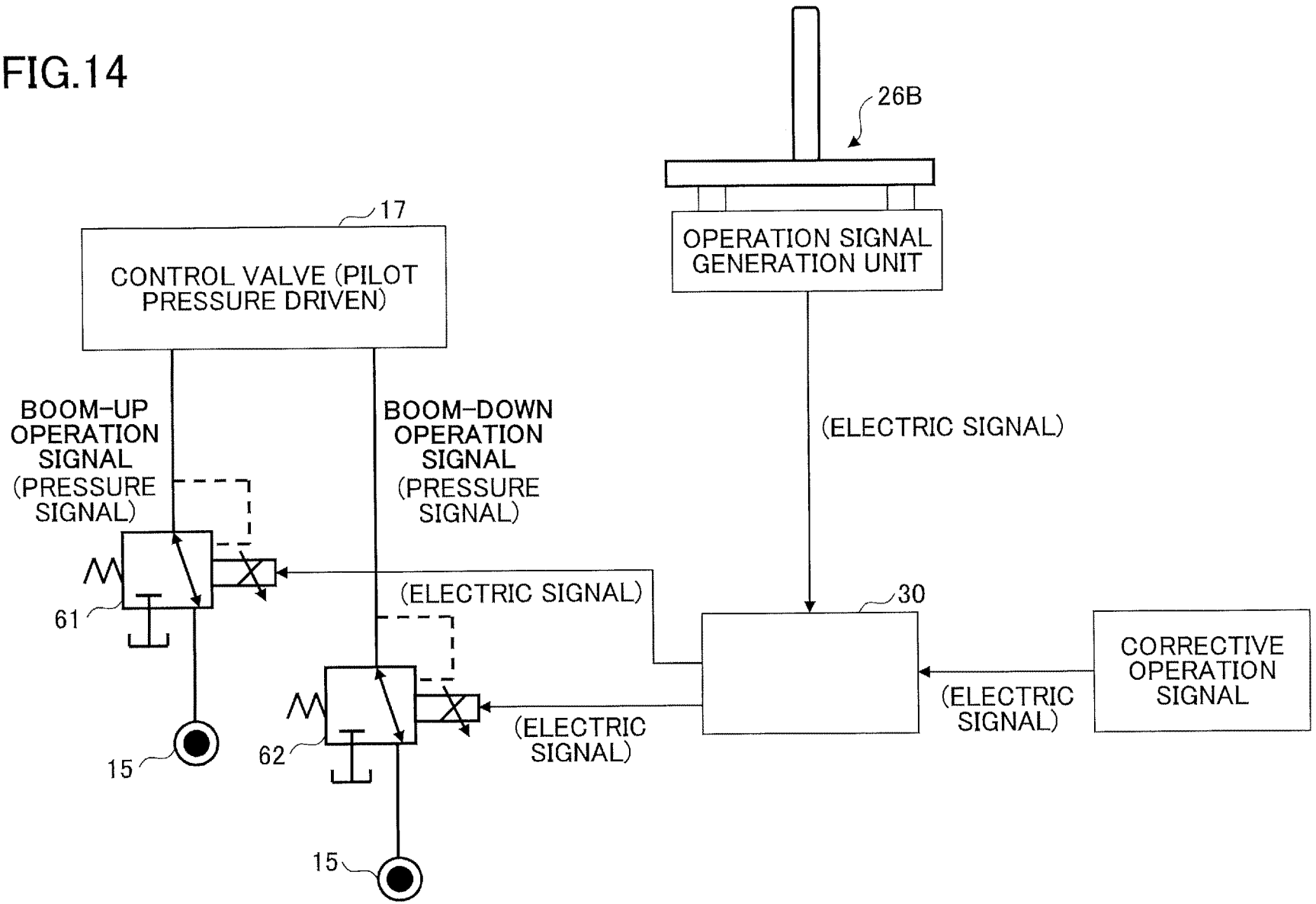
FIG. 14 is a diagram illustrating an example of a configuration of an electrical operation system.
Figure 15:
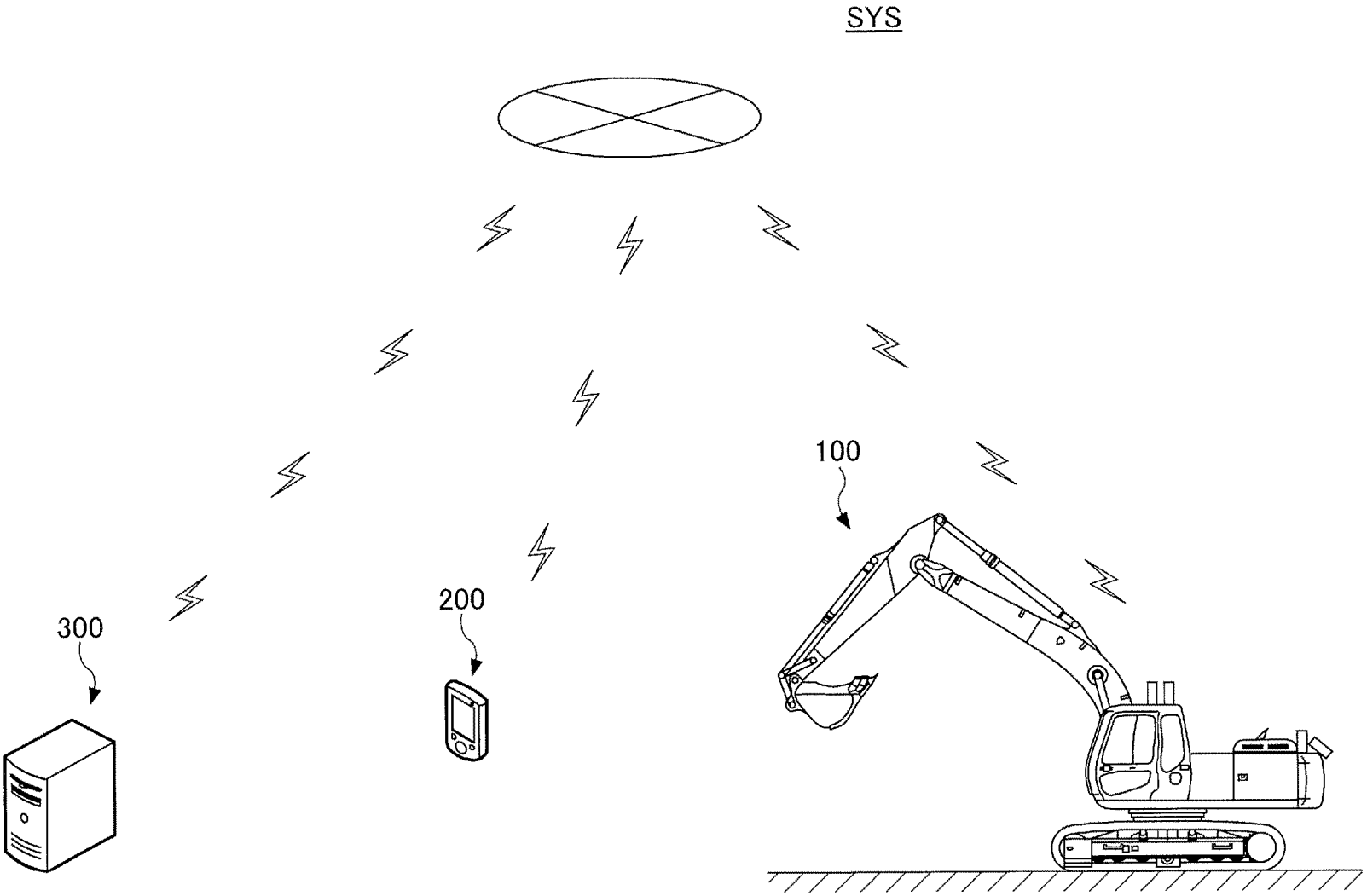
FIG. 15 is a schematic view illustrating an example of a configuration of a shovel management system.
Figure 16:
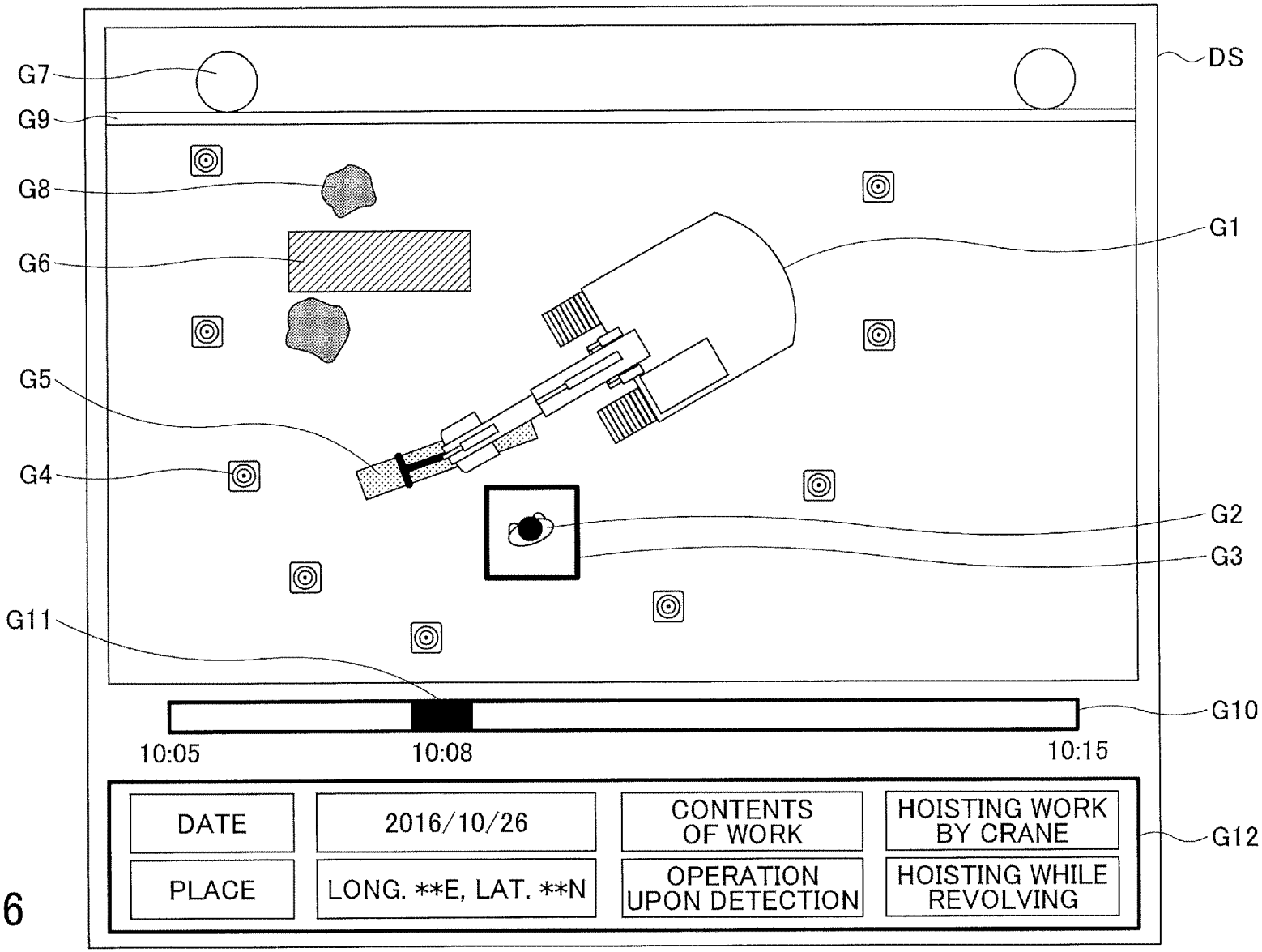
FIG. 16 is a diagram illustrating an example of displays of a CG animation.

However, instead of such hydraulic operation levers each provided with a hydraulic pilot circuit, an electrical operation system provided with electrical operation levers may be adopted. In this case, the operational amount of each electrical operation lever is input into the controller 30, for example, as an electrical signal. Also, a solenoid valve is arranged between the pilot pump 15 and the pilot port of each of the control valves. The solenoid valve is configured to operate in response to an electrical signal from the controller 30. With this configuration, when a manual operation is performed using an electric operation lever, the controller 30 can control the solenoid valves (spool valves) to increase or decrease the pilot pressure by an electrical signal corresponding to the operational amount of the lever, to move each of the control valves to a desired position. In the case of adopting such an electric operating system provided with electric operation levers, the controller 30 can easily make switching between the manual control mode and the automatic control mode. The manual control mode is a mode to cause an actuator to operate in response to a manual operation performed by the operator on the operation device 26, and the automatic control mode is a mode to cause an actuator to operate irrespective of a manual operation. In addition, in the case where the controller 30 switches the manual control mode to the automatic control mode, each of the multiple control valves (spool valves) may be controlled separately in response to an electrical signal corresponding to the operational amount of a corresponding electrical operation lever. FIG. 14 is a diagram illustrating an example of a configuration of an electrical operation system. Specifically, the electric operation system in FIG. 14 is an example of a boom operation system, which is primarily constituted with a pilot-pressure-actuated control valve 17, a boom operation lever 26B as an electric operation lever, a controller 30, a solenoid valve 61 for a boom-up operation, and a solenoid valve 62 for a boom-down operation. The electrical operation system in FIG. 14 may also be applied to an arm operation system, a bucket operation system, a revolution operation system, a traveling operation system, and the like. The pilot-pressure-actuated control valve 17 includes a control valve 175 (see FIG. 3) related to the boom cylinder 7, a control valve 176 (see FIG. 3) related to the arm cylinder 8, and a control valve 174 (see FIG. 3) related to the bucket cylinder 9, and the like. The solenoid valve 61 is configured to be capable of adjusting, for example, the flow area of a line connecting the pilot pump 15, and the right pilot port of the control valve 175L and the left pilot port of the control valve 175R. The solenoid valve 62 is configured to be capable of adjusting, for example, the flow area of a line connecting the pilot pump 15 and the right pilot port of the control valve 175R. In the case where a manual operation is performed, the controller 30 generates a boom-up operation signal (an electrical signal) or a boom-down operation signal (an electrical signal) in response to an operation signal (an electrical signal) output by the operation signal generator of the boom operation lever 26B. The operation signal output by the operation signal generator of the boom operation lever 26B is an electrical signal that varies according to the operational amount and the operational direction of the boom operation lever 26B. Specifically, in the case where the boom operation lever 26B is operated in the boom-up direction, the controller 30 outputs a boom-up operation signal (an electrical signal) corresponding to the operational amount of the lever to the solenoid valve 61. The solenoid valve 61 adjusts the flow area in response to the boom-up operation signal (an electrical signal) to control the pilot pressure as a boom-up operation signal (a pressure signal) acting on the right pilot port of the control valve 175L and the left pilot port of the control valve 175R. Similarly, in the case where the boom operation lever 26B is operated in the boom-down direction, the controller 30 outputs a boom-down operation signal (an electrical signal) corresponding to the operational amount of the lever to the solenoid valve 62. The solenoid valve 62 adjusts the flow area in response to the boom-down operation signal (an electrical signal) to control the pilot pressure as a boom-down operation signal (a pressure signal) acting on the right pilot port of the control valve 175R. In the case of performing automatic control, the controller 30 generates a boom-up operation signal (an electrical signal) or a boom-down operation signal (an electrical signal) in response to, for example, a corrective operation signal (an electrical signal) instead of an operation signal output by the operation signal generator of the boom operation lever 26B. The corrective operation signal may be an electrical signal generated by the controller 30, or an electrical signal generated by an external control device or the like other than the controller 30. Also, information obtained by the shovel 100 may be shared with the manager, the other shovel operators, and the like through a shovel management system SYS as illustrated in FIG. 15. FIG. 15 is a schematic view illustrating an example of a configuration of the shovel management system SYS. The shovel management system SYS is a system to manage one or more shovels 100. In the present embodiment, the management system SYS is primarily constituted with shovels 100, a support device 200, and a management device 300. There may one or more units of the shovels 100, the support device 200, and the management device 300 that constitute the management system SYS. In the example in FIG. 15, the management system SYS includes one shovel 100, one support device 200, and one management device 300. The support device 200 is typically a portable terminal device, such as a notebook PC, a tablet PC, or a smartphone carried by an operator or the like present on a construction site. The support device 200 may be a computer carried by an operator of the shovel 100. The support device 200 may be a fixed terminal device. The management device 300 is typically a fixed terminal device, for example, a server computer installed in a management center or the like outside a construction site. The management device 300 may be a portable computer (e.g., a portable terminal device such as a notebook PC, tablet PC, or smartphone). At least one of the support device 200 and the management device 300 may be equipped with a monitor and an operation device for remote control. In this case, the operator may operate the shovel 100 by using the operation device for remote control. The operation device for remote control is connected to the controller 30, for example, through a communication network such as a wireless communication network. In the following, although exchange of information between the shovel 100 and the management device 300 will be described, the following description applies similarly to exchange of information between the shovel 100 and the support device 200. In the shovel management system SYS as described above, the controller 30 of the shovel 100 may transmit information on in which detection space an object is detected; and information on the contents of work and at least one of the operational direction, the pilot pressure, the cylinder pressure, and the like of a driven object, to the management device 300 as the object-related information when the object is being detected. The object-related information may include at least one of data related to the sound obtained by a microphone installed on the shovel 100, data related to the tilt of the ground, data related to the position of the shovel 100, and data related to the position of the excavation attachment. The data related to the tilt of the ground may be, for example, a value detected with a machine inclination sensor S4, or may be information derived from the detected value. Also, the object-related information may include at least one of an output value of the object detection device 70 and an image or the like captured by the imaging device 80. The object-related information may be obtained continuously or intermittently over a predetermined monitoring period that includes a predetermined period before detecting an object, a point in time when an object is detected, a predetermined period after detecting the object. Typically, the object-related information is temporarily stored in a volatile storage device or a non-volatile storage device in the controller 30, and transmitted to the management device 300 at an appropriate timing. The management device 300 is configured to present the received object-related information to the user of the management device 300 so that the user can grasp the situation of the working site. In the present embodiment, the management device 300 is configured to visually reproduce the situation of the working site when an object is being detected in the detection spaces. Specifically, the management device 300 generates computer graphics animation using the received object-related information. In the following, computer graphics will be denoted as "CG". FIG. 16 illustrates a display example of a CG animation CX generated by the management device 300. The CG animation CX is an example of a playback image of the working site and is displayed on the display device DS connected to the management device 300. The display device DS is, for example, a touch panel monitor. In the example in FIG. 16, the CG animation CX is a CG animation that reproduce the situation of the crane work illustrated in FIG. 9 from a viewpoint located directly above, which includes images G1 to G12. Multiple object detection devices 70 are installed on the shovel 100 illustrated in FIG. 9 so as to be capable of monitoring the surroundings of the shovel 100. Therefore, the controller 30 and the management device 300 that receives information from the controller 30, can precisely obtain information on the positional relationship between the shovel 100 and an object present in the surroundings of the shovel 100. An image G1 is CG presenting the shovel 100. An image G2 is CG presenting an object detected in a detection space. In the example in FIG. 16, the controller 30 detects a person in the detection space. An image G3 is a frame image surrounding the image G2. The image G3 is displayed to highlight the position of the object. An image G4 is CG presenting a road cone. An image G5 is CG of the sewer pipe BP hoisted by the shovel 100. An image G6 is CG of the excavated ditch EX formed on the road. An image G7 is CG of a utility pole. An image G8 is CG of earth and sand excavated when the excavated ditch EX was formed. An image G9 is CG of a guardrail extending along the road. An image G10 is a seek bar that displays a playback position of the CG animation CX. An image G11 is a slider indicating the current playback position of the CG animation CX. An image G12 is a text image that displays various information items. Note that the images G2 and G4 to G9 may be images generated by applying a viewpoint conversion process to images captured by the imaging device 80. In other words, the management device 300 may play back a moving image captured by the imaging device 80 on the display device DS as another example of a playback image of the working site, instead of the CG animation. In the example in FIG. 16, the image G12 includes a text image of "Oct. 26, 2016" indicating the date on which the work was performed, a text image of "LONG. E, LAT. N" indicating the place where the work was performed, a text image of "hoisting work by crane" indicating the work contents, and a text image of "hoisting while revolving" indicating the operation performed by the shovel 100 when an object is detected. The image G1 is displayed so as to move based on data related to the position of the shovel 100, data related to the position of excavation attachment, and the like, which are included in the object-related information. The data related to the position of the shovel 100 includes, for example, the pitch angle, the roll angle, and the yaw angle (the angle of revolution), and the like of the revolving upper body 3. The data related to the position of the excavation attachment includes, for example, the boom angle, the arm angle, the bucket angle, and the like. The user of the management device 300 can change the playback position of the CG animation CX to a desired position (point in time) by, for example, touching the desired position on the image G10 (seek bar). FIG. 16 illustrates that the situation of the working site at 10:08 a.m. designated with the slider is played back as the CG Animation CX. With the CG animation CX as such, the manager as the user of the management device 300 can easily grasp, for example, the situation of the working site when an object is detected. In other words, the management system SYS allows the manager to analyze the cause of the motion restriction of the shovel 100, and further allows the manager to improve the work environment of the shovel 100 based on such analysis results. Also, a playback image of the working site, such as a CG animation or moving image, may be displayed not only on the display device DS connected to the management device 300, but also on a display device installed on the support device 200, or on a display device DS installed in the cabin 10 of the shovel 100.

What is claimed is:

1. A shovel comprising:

a traveling lower body;

a revolving upper body rotatably installed on the traveling lower body;

an attachment attached to the revolving upper body, the attachment including a driven object;

an object detection device provided on the revolving upper body;

a control device provided in the revolving upper body;

a display device; and an actuator configured to move the driven object, wherein the object detection device is configured to detect an object in a detection space set in surroundings of the shovel, the detection space being part of a space monitored by the object detection device, wherein the display device is configured to display, regardless of whether the object detection device has detected an object, an image in the detection space obtained by the object detection device, or an image in the detection space obtained by an imaging device provided separately from the object detection device, wherein the detection space includes a first detection space with respect to the attachment, the first detection space being divided into a plurality of spaces, among which at least two spaces are spatially arranged one above another in a vertical direction, wherein the control device is configured to determine whether the object is detected based on an output of the object detection device, determine whether a motion of the driven object is toward the detected object in response to determining that the object is detected, and brake or inhibit the motion of the driven object in response to determining that the motion of the driven object is toward the detected object, and allow the motion of the driven object in response to determining that the motion of the driven object is not toward the detected object, and wherein a range of the detection space is set to be variable depending on a position of the attachment attached to the revolving upper body.

2. The shovel as claimed in claim 1, wherein the control device is configured to determine whether the motion of the driven object is toward the detected object based on a direction of operation of an operation device for the driven object.

3. The shovel as claimed in claim 1, wherein the detection space further includes a second detection space with respect to the revolving upper body and a third detection space with respect to the traveling lower body, and wherein the second detection space and the third detection space are set separately.

4. The shovel as claimed in claim 1, wherein, with respect to each of the plurality of spaces, the motion of the driven object allowed by the control device when the objected is detected in said each of the plurality of spaces is preset.

5. The shovel as claimed in claim 1, wherein the plurality of spaces includes a space set on an upper side of the attachment.

6. The shovel as claimed in claim 1, wherein a width of the first detection space is narrower than a width of the revolving upper body.

7. The shovel as claimed in claim 1, wherein the detection space includes a second detection space with respect to the revolving upper body and a third detection space with respect to the traveling lower body, and wherein a positional relationship between the second detection space and the third detection space changes depending on an angle of revolution.

8. The shovel as claimed in claim 1, wherein the detection space further includes a third detection space with respect to the traveling lower body, and wherein a positional relationship between the first detection space and the third detection space changes depending on an angle of revolution.

9. The shovel as claimed in claim 1, wherein a size of the first detection space changes depending on a motion of the attachment.

10. The shovel as claimed in claim 1, wherein a size of the plurality of spaces is set based on a current radius of revolution or a maximum radius of revolution of the attachment.

11. The shovel as claimed in claim 1, wherein the control device is configured to inhibit the motion of the driven object that causes an object lifted by the attachment to approach the detected object, and to allow the motion of the driven object that causes the object lifted by the attachment to move away from the detected object.

12. The shovel as claimed in claim 1, wherein the detection space further includes a second detection space with respect to the revolving upper body and a third detection space with respect to the traveling lower body, wherein the second detection space and the third detection space partially overlap each other, so as to be capable of detecting a same object simultaneously in the second detection space and in the third detection space.

13. The shovel as claimed in claim 1, wherein the detection space further includes a second detection space with respect to the revolving upper body and a third detection space with respect to the traveling lower body, the second detection space and the third detection space being separately set, and in a case where a same single object is detected simultaneously in the second detection space and the third detection space, operational restriction of an actuator with respect to the revolving upper body and operational restriction of an actuator with respect to the traveling lower body are executed separately.

14. The shovel as claimed in claim 1, wherein the attachment is attached to the revolving upper body, the detection space further includes a third detection space with respect to the traveling lower body, the third detection space being set separately from the first detection space, and in a case where a same single object is detected simultaneously in the second detection space and the third detection space, operational restriction of the actuator of the attachment and operational restriction of an actuator with respect to the traveling lower body are executed separately.

15. The shovel as claimed in claim 1, wherein the attachment is attached to the revolving upper body, the detection space further includes a second detection space with respect to the revolving upper body and a third detection space with respect to the traveling lower body, the first detection space, the second detection space, and the third detection space being separately set, and in a case where a same single object is detected simultaneously in the first detection space, the second detection space, and the third detection space, operational restriction of an actuator with respect to the revolving upper body, operational restriction of an actuator with respect to the traveling lower body, and operational restriction of the actuator of the attachment are executed separately.

16. The shovel as claimed in claim 1, wherein the attachment includes a boom attached to the revolving upper body, an arm attached to the boom, and an end attachment attached to the arm, the driven object is one of the boom, the arm, or the end attachment, and the at least two spaces includes a space on an upper side of the attachment on an upper side of a virtual horizontal plane where the shovel is positioned and a space on a lower side of the attachment on the upper side of the virtual horizontal plane.

17. The shovel as claimed in claim 16, wherein the space on the upper side of the attachment and the space on the lower side of the attachment are across the attachment from each other over the virtual horizontal plane.

18. The shovel as claimed in claim 1, wherein the at least two spaces includes a space on an upper side of a virtual horizontal plane where the shovel is positioned and a space on a lower side of the virtual horizontal plane.

19. The shovel as claimed in claim 18, wherein the space on the lower side of the virtual horizontal plane vertically extends downward from the virtual horizontal plane over a distance that is based on a deepest reachable point of the attachment.

20. The shovel as claimed in claim 18, wherein the space on the upper side of the virtual horizontal plane vertically extends upward from the virtual horizontal plane over a distance that is based on a highest reachable point of the attachment.

* * * * *